US012522333B2

(12) United States Patent
Roy-Bernier et al.

(10) Patent No.: US 12,522,333 B2
(45) Date of Patent: Jan. 13, 2026

(54) JET PROPULSION SYSTEM WITH IN-NOZZLE DEFLECTOR GATE

(71) Applicant: TAIGA MOTORS INC., Lasalle (CA)

(72) Inventors: Clovis Roy-Bernier, Montreal (CA); Stanislas Barrier, Montreal (CA)

(73) Assignee: TAIGA MOTORS INC., Lasalle (CA)

( * ) Notice: Subject to any disclaimer, the term of this patent is extended or adjusted under 35 U.S.C. 154(b) by 542 days.

(21) Appl. No.: 18/112,188

(22) Filed: Feb. 21, 2023

(65) Prior Publication Data

US 2023/0286633 A1 Sep. 14, 2023

Related U.S. Application Data

(60) Provisional application No. 63/269,002, filed on Mar. 8, 2022.

(51) Int. Cl.
*B63H 11/113* (2006.01)
*B63H 11/11* (2006.01)

(52) U.S. Cl.
CPC ..... *B63H 11/113* (2013.01); *B63H 11/11* (2013.01)

(58) Field of Classification Search
CPC ..... B63H 11/107; B63H 11/11; B63H 11/113; B63H 11/117; B63H 21/21; B63H 21/213; B63H 2021/216
See application file for complete search history.

(56) References Cited

U.S. PATENT DOCUMENTS 3,187,708 A * 6/1965 Fox ..... B63H 11/117 440/46
5,803,775 A * 9/1998 Henmi ..... B63H 11/10 440/42
5,989,083 A * 11/1999 Ishigaki ..... B63H 11/11 440/46
6,238,257 B1 * 5/2001 Platzer ..... B63H 11/11 440/38
6,652,332 B1 11/2003 Westhoff
6,857,920 B2 2/2005 Marathe et al.
6,875,064 B2 4/2005 Westhoff et al.
7,115,008 B2 10/2006 Nash
7,422,499 B2 9/2008 Nakatsuji
7,674,144 B2 3/2010 Bourret et al.
7,708,609 B2 5/2010 Plante et al.
7,841,915 B2 11/2010 Bourret et al.
7,901,259 B2 3/2011 Bourret
(Continued)

FOREIGN PATENT DOCUMENTS

WO WO-0017045 A2 * 3/2000 ..... B63H 11/113

*Primary Examiner* — Andrew Polay
(74) *Attorney, Agent, or Firm* — Norton Rose Fulbright Canada LLP

(57) ABSTRACT

A jet propulsion system includes a housing and an impeller positioned within the housing interior. A nozzle is positioned at least partially downstream of the housing outlet and a deflector gate is positioned within the nozzle interior. The deflector gate has a first end, a second end and a pivot provided at the first end. The deflector gate is pivotable relative to the nozzle about a pivot axis defined by the pivot between a default position and a deflector position. The deflector gate in the default position having the second end downstream of the first end, and in the deflector position deflecting at least some of the water out of an opening of the nozzle in an upstream direction.

20 Claims, 11 Drawing Sheets

(56) References Cited

U.S. PATENT DOCUMENTS

| | | | |
|---|---|---|---|
| 8,177,592 | B2 | 5/2012 | Kamio |
| 8,177,594 | B2 | 5/2012 | Dagenais et al. |
| 8,206,191 | B2 | 6/2012 | Ota et al. |
| 8,579,668 | B2 | 11/2013 | Minoura et al. |
| 8,702,457 | B2 | 4/2014 | Minoura et al. |
| 9,193,425 | B2 | 11/2015 | Kaneko et al. |
| 9,248,895 | B1 | 2/2016 | Gendron et al. |
| 9,376,188 | B2 | 6/2016 | Okamoto |
| 9,376,189 | B1 | 6/2016 | De Henau et al. |
| 9,403,586 | B2 | 8/2016 | Okamoto et al. |
| 9,463,854 | B2 | 10/2016 | Kinoshita |
| 9,517,826 | B1 | 12/2016 | Leblond |
| 9,527,564 | B2 | 12/2016 | Kinoshita |
| 9,545,984 | B2 | 1/2017 | Okamoto |
| 9,650,121 | B2 | 5/2017 | Kinoshita et al. |
| 9,682,757 | B1 | 6/2017 | Bourret |
| 9,725,148 | B2 | 8/2017 | Kinoshita |
| 9,783,277 | B2 | 10/2017 | Kaneko et al. |
| 9,908,601 | B2 | 3/2018 | Vachon |
| 9,926,062 | B2 | 3/2018 | Anma |
| 10,040,518 | B1 | 8/2018 | Matsuda et al. |

* cited by examiner

JET PROPULSION SYSTEM WITH IN-NOZZLE DEFLECTOR GATE

CROSS-REFERENCE TO RELATED APPLICATION

This application claims priority from U.S. Provisional Patent Application No. 63/269,002, filed Mar. 8, 2022, which is incorporated by reference in its entirety herein.

TECHNICAL FIELD

The application relates generally to jet propulsion systems and, more particularly, to jet propulsion systems for personal watercraft.

BACKGROUND

Some personal watercraft generate a jet of water to propel the personal watercraft in a forward direction of travel. It may sometimes be desirable for a personal watercraft to travel in a direction opposite to the forward direction, i.e., a reverse direction. Further, it may be desirable to steer the personal watercraft while it is travelling the reverse direction.

SUMMARY

There is disclosed a jet propulsion system, comprising: a housing extending between an inlet and an outlet, the housing having an inner wall delimiting a housing interior; an impeller positioned within the housing interior to draw water into the housing interior via the inlet and to expel the water from the outlet in a downstream direction; a nozzle positioned at least partially downstream of the outlet and defining a nozzle interior to receive the water expelled from the outlet; and a deflector gate positioned at least partially within the nozzle interior, the deflector gate having a first end, a second end and a pivot provided at the first end, the deflector gate pivotable relative to the nozzle about a pivot axis defined by the pivot between a default position and a deflector position, the deflector gate in the default position having the second end downstream of the first end and in the deflector position deflecting at least some of the water out of an opening of the nozzle in an upstream direction.

In some embodiments, the deflector gate is pivotably mounted to one of the nozzle and the housing at the pivot, and the pivot is positioned adjacent to an upstream end of the nozzle and/or adjacent to the outlet of the housing.

In some embodiments, the nozzle is pivotably displaceable in the vertical direction to orient the downstream end through a range of angular positions including an upper trim limit, the deflector gate being caused to pivot to the deflector position upon the nozzle having displaced through the range of angular positions.

In some embodiments, the jet propulsion system includes an actuator connected to the deflector gate and configured to displace the deflector gate to the deflector position.

In some embodiments, the jet propulsion system includes an actuator connected to the nozzle and to the deflector gate and operable through a range of actuation, the range of actuation comprising: a first range portion in which the actuator adjusts a nozzle trim of the nozzle to a trim limit, and a second range portion in which the actuator pivots the deflector gate relative to the nozzle, the nozzle trim having reached the trim limit when the actuator operates in the second range portion.

In some embodiments, the actuator is configured to displace the deflector gate to the deflector position only upon the nozzle having reached the trim limit.

In some embodiments, the trim limit corresponds to the nozzle abutting against an outer wall of the housing.

In some embodiments, the deflector gate is stationary relative to the nozzle when the actuator operates in the first range portion.

In some embodiments, the deflector gate pivots relative to the nozzle when the actuator operates in the first range portion.

In some embodiments, the second range portion occurs upon the nozzle having displaced upwardly to the trim limit.

In some embodiments, the deflector gate is displaceable to a deflector position in the second range portion, the deflector gate in the deflector position deflecting at least some of the water out of an opening of the nozzle in an upstream direction.

In some embodiments, the nozzle has a first opening, the nozzle further defining a second opening at a downstream end to eject the water in the downstream direction.

In some embodiments, the actuator is positioned outside of the nozzle and outside of the housing.

In some embodiments, the deflector gate remains stationary upon the nozzle being pivoted relative to the housing to a position less than the trim limit.

In some embodiments, the nozzle includes an upper portion positioned above a lower portion, the deflector gate pivotable relative to the nozzle in a downward direction starting in the upper portion and terminating at the deflector position in the lower portion.

In some embodiments, the nozzle has an opening defined between an outer wall of the housing and the nozzle interior at an upstream end of the nozzle upon the nozzle being at the trim limit.

In some embodiments, the nozzle includes an upper portion positioned above a lower portion, the lower portion having a flow guide defining at least part of the opening.

In some embodiments, the actuator is configured to displace the nozzle and the deflector gate together prior to the nozzle reaching the trim limit.

In some embodiments, the nozzle includes an upper portion positioned above a lower portion, the deflector gate pivotable relative to the nozzle in an upward direction starting in the lower portion and terminating at the deflector position in the upper portion.

In some embodiments, the nozzle includes an upper portion positioned above a lower portion, an opening of the nozzle defined at least in part by an aperture in the lower portion, the deflector gate being displaceable through the aperture between a default position and the deflector position.

In some embodiments, the deflector gate includes a flow guide displaceable through the aperture as the deflector gate pivots relative to the nozzle between the default position and the deflector position.

In some embodiments, the lower portion of the nozzle has a recessed segment, at least part of the deflector gate disposed in the recessed segment in the default position, the deflector gate blocking the aperture in the default position.

In some embodiments, the jet propulsion system includes a pivot ring disposed at an upstream end of the nozzle, the actuator connected to the pivot ring.

In some embodiments, the actuator includes a first actuator connected to the deflector gate, and a second actuator connected to the nozzle and configured to pivotably displace the nozzle.

In some embodiments, the actuator is also connected to the nozzle and configured to pivotably displace the nozzle.

In some embodiments, the nozzle is pivotably displaceable in the vertical direction to orient the downstream end through a range of angular positions including the trim limit, the actuator configured to actuate the nozzle through the range of angular positions, the actuator configured to actuate only the deflector gate to displace the deflector gate to the deflector position upon the nozzle having displaced through the range of angular positions.

In some embodiments, the opening of the nozzle is in a bottom of the nozzle.

In some embodiments, the deflector gate has a semi-cylindrical shape.

In some embodiments, the jet propulsion system includes a steering mechanism with a control for controlling actuation of the actuator to displace the deflector gate.

In some embodiments, a personal watercraft (PWC) includes the jet propulsion system, wherein the PWC is an electric personal watercraft.

There is disclosed a jet propulsion system, comprising: a housing extending between an inlet and an outlet, the housing having an inner wall delimiting a housing interior; an impeller positioned within the housing interior to draw water into the housing interior via the inlet and to expel the water from the outlet in a downstream direction; a nozzle positioned at least partially downstream of the outlet and defining a nozzle interior to receive the water expelled from the outlet, the nozzle pivotably displaceable relative to the housing in at least a vertical direction to adjust nozzle trim; a deflector gate positioned at least partially within the nozzle interior and pivotable relative to the nozzle; and an actuator connected to the nozzle and to the deflector gate and operable through a range of actuation, the range of actuation comprising: a first range portion in which the actuator adjusts the nozzle trim to a trim limit, and a second range portion in which the actuator pivots the deflector gate relative to the nozzle, the nozzle trim having reached the trim limit when the actuator operates in the second range portion.

In some embodiments, the deflector gate is pivotably mounted to one of the nozzle and the housing at a pivot, and the pivot is positioned adjacent to an upstream end of the nozzle and/or adjacent to the outlet of the housing.

In some embodiments, the actuator is configured to displace the deflector gate to the deflector position only upon the nozzle having reached the trim limit.

In some embodiments, the trim limit is an upper trim limit corresponding to the nozzle abutting against an outer wall of the housing.

In some embodiments, the nozzle is pivotably displaceable in the vertical direction to orient a downstream end through a range of angular positions including the trim limit, the deflector gate being caused to pivot to the deflector position upon the nozzle having displaced through the range of angular positions.

In some embodiments, the deflector gate is stationary relative to the nozzle when the actuator operates in the first range portion.

In some embodiments, the deflector gate pivots relative to the nozzle when the actuator operates in the first range portion.

In some embodiments, the second range portion occurs upon the nozzle having displaced upwardly to the trim limit.

In some embodiments, the deflector gate is displaceable to a deflector position in the second range portion, the deflector gate in the deflector position deflecting at least some of the water out of an opening of the nozzle in an upstream direction.

In some embodiments, the nozzle has a first opening to eject water in an upstream direction, the nozzle further defining a second opening at a downstream end to eject the water in the downstream direction.

In some embodiments, the nozzle is pivotably mounted to the housing adjacent to the outlet, the nozzle extending between an upstream end adjacent to the outlet and a downstream end.

In some embodiments, the actuator is positioned outside of the nozzle and outside of the housing.

In some embodiments, the deflector gate remains stationary upon the nozzle being pivoted relative to the housing to a position less than the trim limit.

In some embodiments, the nozzle includes an upper portion positioned above a lower portion, the deflector gate pivotable relative to the nozzle in a downward direction starting in the upper portion and terminating at the deflector position in the lower portion.

In some embodiments, an opening of the nozzle is defined between an outer wall of the housing and the nozzle interior at the upstream end of the nozzle upon the nozzle being at the trim limit.

In some embodiments, the nozzle includes an upper portion positioned above a lower portion, the lower portion having a flow guide defining at least part of the opening.

In some embodiments, the actuator is configured to displace the nozzle and the deflector gate together prior to the nozzle reaching the trim limit.

In some embodiments, the nozzle includes an upper portion positioned above a lower portion, the deflector gate pivotable relative to the nozzle in an upward direction starting in the lower portion and terminating at the deflector position in the upper portion.

In some embodiments, the nozzle includes an upper portion positioned above a lower portion, an opening of the nozzle defined at least in part by an aperture in the lower portion, the deflector gate being displaceable through the aperture between a default position and the deflector position.

In some embodiments, the deflector gate includes a flow guide displaceable through the aperture as the deflector gate pivots relative to the nozzle between the default position and the deflector position.

In some embodiments, the lower portion of the nozzle has a recessed segment, at least part of the deflector gate disposed in the recessed segment in the default position, the deflector gate blocking the aperture in the default position.

In some embodiments, the jet propulsion system includes a pivot ring disposed at an upstream end of the nozzle, the actuator connected to the pivot ring.

In some embodiments, the actuator includes a first actuator connected to the deflector gate, and a second actuator connected to the nozzle and configured to pivotably displace the nozzle.

In some embodiments, the nozzle is pivotably displaceable in the vertical direction to orient a downstream end through a range of angular positions including the trim limit, the actuator configured to actuate the nozzle through the range of angular positions, the actuator configured to actuate only the deflector gate to displace the deflector gate to the deflector position upon the nozzle having displaced through the range of angular positions.

In some embodiments, an opening of the nozzle is in a bottom of the nozzle.

In some embodiments, the deflector gate has a semi-cylindrical shape.

In some embodiments, the jet propulsion system includes a steering mechanism with a control for controlling actuation of the actuator to displace the deflector gate.

In some embodiments, a personal watercraft (PWC) includes the jet propulsion system, wherein the PWC is an electric personal watercraft.

There is disclosed a method of braking or reversing a personal watercraft (PWC), the method comprising: creating a flow of water with the PWC to flow downstream from an inlet to an outlet of a steering nozzle of the PWC; and operating an actuator through a range of actuation comprising a first range portion and a second range portion, operating the actuator in the first range portion comprising trimming the steering nozzle to a trim limit, and operating the actuator in the second range portion comprising displacing a deflector gate within the steering nozzle to deflect at least some of the flow of water out of the steering nozzle in a direction that is at least partially upstream.

In some embodiments, trimming the steering nozzle to the trim limit includes abutting part of the steering nozzle against a mechanical stop of the PWC.

In some embodiments, displacing the deflector gate includes fully blocking the outlet of the steering nozzle.

In some embodiments, displacing the deflector gate includes partially blocking the outlet of the steering nozzle.

In some embodiments, the method includes selecting one of a braking drive mode and a reverse drive mode of the PWC to thereby cause trimming the steering nozzle to the trim limit and displacement of the deflector gate.

In some embodiments, displacing the deflector gate to deflect the at least some of the flow of water out of the steering nozzle includes reversing the PWC and simultaneously manipulating a steering mechanism of the PWC.

In some embodiments, trimming the steering nozzle to the trim limit and displacing the deflector gate includes actuating the nozzle to the trim limit and subsequently actuating only displacement of the deflector gate.

In some embodiments, trimming the steering nozzle to the trim limit and displacing the deflector gate includes throttling a brake of the PWC.

In some embodiments, trimming the steering nozzle to the trim limit includes maintaining the deflector gate stationary relative to the steering nozzle until the steering nozzle reaches the trim limit.

In some embodiments, displacing the deflector gate includes pivoting the deflector gate downward relative to the steering nozzle.

In some embodiments, trimming the steering nozzle to the trim limit includes forming an opening at a bottom of the steering nozzle through which the at least some of the flow of water is deflected.

In some embodiments, trimming the steering nozzle to the trim limit includes displacing the steering nozzle and the deflector gate together prior to the steering nozzle reaching the trim limit.

In some embodiments, operating the actuator through the first range portion includes trimming the steering nozzle while simultaneously pivoting the deflector gate relative to the steering nozzle; and operating the actuator through the second range portion includes pivoting the steering nozzle past the trim limit while simultaneously pivoting the deflector gate relative to the steering nozzle.

In some embodiments, displacing the deflector gate includes pivoting the deflector gate upward relative to the steering nozzle.

There is disclosed a jet propulsion system, comprising: a housing extending between an inlet and an outlet, the housing having an inner wall delimiting a housing interior; an impeller positioned within the housing interior to draw water into the housing interior via the inlet and to expel the water from the outlet in a downstream direction; a nozzle positioned at least partially downstream of the outlet and defining a nozzle interior to receive the water expelled from the outlet; a deflector gate positioned within the nozzle interior, the deflector gate having a first end and a second end and defining a partially cylindrical shape extending from the first end to the second end, the deflector gate pivotable relative to the nozzle to a deflector position, the deflector gate in the deflector position deflecting at least some of the water out of an opening of the nozzle in an upstream direction.

In some embodiments, the partially cylindrical shape of the deflector gate and a substantially cylindrical shape of the nozzle have a common longitudinal axis when the deflector gate is in a default position.

In some embodiments, the partially cylindrical shape of the deflector gate tapers radially inwardly from the first end to the second end.

In some embodiments, the second end of the deflector gate comprises a curved edge, a curvature of the curved edge corresponding to a curvature of the nozzle interior.

In some embodiments, the jet propulsion system includes a linear actuator.

In some embodiments, the deflector gate is pivotably mounted to one of the nozzle and the housing.

In some embodiments, the jet propulsion system includes an actuator connected to the deflector gate and configured to displace the deflector gate to the deflector position.

In some embodiments, the actuator is configured to displace the deflector gate to the deflector position only upon the nozzle having reached an upper trim limit.

In some embodiments, the nozzle has reached the upper trim limit upon the nozzle abutting against an outer wall of the housing.

In some embodiments, the nozzle is pivotably displaceable in the vertical direction to orient a downstream end through a range of angular positions including an upper trim limit, the deflector gate being caused to pivot to the deflector position upon the nozzle having displaced through the range of angular positions.

In some embodiments, the nozzle has a first opening to eject the water in the upstream direction, the nozzle further defining a second opening at a downstream end to eject the water in the downstream direction.

In some embodiments, the jet propulsion system includes an actuator positioned outside of the nozzle and outside of the housing.

In some embodiments, the deflector gate remains stationary upon the nozzle being pivoted relative to the housing to a position less than a trim limit.

In some embodiments, the nozzle includes an upper portion positioned above a lower portion, the deflector gate pivotable relative to the nozzle in a downward direction starting in the upper portion and terminating at the deflector position in the lower portion.

In some embodiments, an opening of the nozzle is defined between an outer wall of the housing and the nozzle interior at the upstream end of the nozzle upon the nozzle being in the upper trim position.

In some embodiments, the nozzle includes an upper portion positioned above a lower portion, the lower portion having a flow guide defining at least part of the opening.

In some embodiments, the jet propulsion system includes an actuator configured to displace the nozzle and the deflector gate together prior to the nozzle reaching an upper trim limit.

In some embodiments, the nozzle includes an upper portion positioned above a lower portion, the deflector gate pivotable relative to the nozzle in an upward direction starting in the lower portion and terminating at the deflector position in the upper portion.

In some embodiments, the nozzle includes an upper portion positioned above a lower portion, an opening of the nozzle defined at least in part by an aperture in the lower portion, the deflector gate being displaceable through the aperture between a default position and the deflector position.

In some embodiments, the deflector gate includes a flow guide displaceable through the aperture as the deflector gate pivots relative to the nozzle between the default position and the deflector position.

In some embodiments, the lower portion of the nozzle has a recessed segment, at least part of the deflector gate disposed in the recessed segment in the default position, the deflector gate blocking the aperture in the default position.

In some embodiments, the jet propulsion system includes a pivot ring disposed at the upstream end of the nozzle, and an actuator connected to the pivot ring.

In some embodiments, the jet propulsion system includes a first actuator connected to the deflector gate, and a second actuator connected to the nozzle and configured to pivotably displace the nozzle.

In some embodiments, the nozzle is pivotably displaceable in a vertical direction to orient the downstream end through a range of angular positions including an upper trim limit, an actuator configured to actuate the nozzle through the range of angular positions, the actuator configured to actuate only the deflector gate to displace the deflector gate to the deflector position upon the nozzle having displaced through the range of angular positions.

In some embodiments, an opening of the nozzle in a bottom of the nozzle.

DESCRIPTION OF THE DRAWINGS

Reference is now made to the accompanying figures in which.

DETAILED DESCRIPTION

The following disclosure relates, in part, to watercraft and associated methods for operating watercraft. The watercraft are drivingly engaged to drive systems for effecting propulsion of the watercraft in both a forward direction and a reverse direction. The drive systems may comprise an electric motor and/or a combustion engine for driving a jet pump to effect propulsion. The disclosure herein may be applicable to powersport vehicles such as personal watercraft (PWCs), for example. Alternatively or additionally, the disclosure herein may be applicable to other types of watercraft, including boats, ships and submarines. In some embodiments, the watercraft and methods described herein may, based on one or more positions of an input device, determine the forward direction and reverse direction of propulsion for the vehicle.

The terms "connected", "connects" and "coupled to" may include both direct connection and coupling (in which two elements contact each other) and indirect connection and coupling (in which at least one additional element is located between the two elements).

At least part of the following disclosure relates to electric watercraft, but could also be applicable to combustion engine or hybrid (electric and combustion) watercraft. Examples of suitable electric watercraft include personal watercraft (PWC) having a straddle seat for accommodating an operator and optionally one or more passengers.

Figure 1:
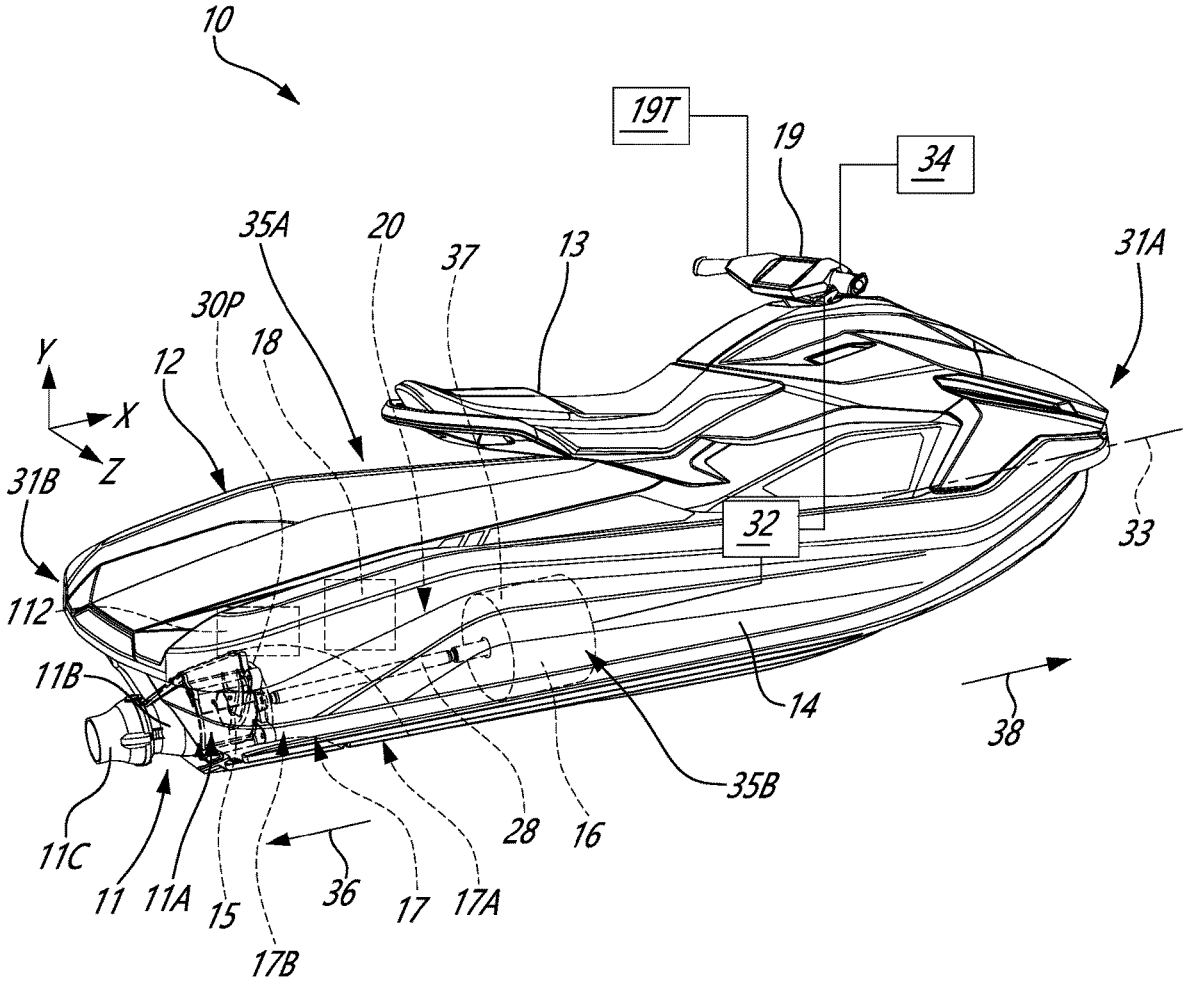
FIG. 1 is a perspective view of a watercraft.

FIG. 1 illustrates a watercraft 10 of a type preferably used for transporting one or more passengers over a body of water. The watercraft 10 is therefore sometimes referred to herein as a "personal watercraft 10" or "PWC 10". The PWC 10 of FIG. 1 is electrically powered. An upper portion of the PWC 10 is formed of a deck 12 including a straddle seat 13 for accommodating a driver of the PWC 10 and optionally one or more passengers. A lower portion of the PWC 10 is formed of a hull 14 which sits in the water. The hull 14 and the deck 12 enclose an interior volume 37 of the PWC 10 which provides buoyancy to the PWC 10 and houses components thereof. A non-limiting list of components of the PWC 10 that may be located in the interior volume 37 include an electric motor 16, one or more electric batteries 18 and other components for an electric drive system 20 of the PWC 10. The hull 14 may also include strakes and chines which provide, at least in part, riding and handling characteristics of the PWC 10. The interior volume 37 may also include any other components suitable for use with PWC 10, such as storage compartments, for example.

The PWC 10 includes a jet propulsion system 11 to create a pressurized jet of water which provides thrust to propel the PWC 10 through the water. The jet propulsion system 11 includes a rotatable impeller 15 disposed in the water to draw water through a water intake 17 on an underside of the hull 14, with the water being directed to a jet pump 11A. The water intake 17 is a passage formed by walls of the hull 14, and extends downstream from an opening in the underside of the hull 14 to an upright, internal rear wall 14A (see FIG. 2A) of the hull 14. The water intake 17 is in the form of a ramp which extends from a water intake inlet 17A at the opening in the underside of the hull 14, to a water intake outlet 17B at the internal rear wall 14A. The water intake inlet 17A is covered by a grate 17C (see FIG. 2A) or other body to prevent the ingress of debris into the water intake 17. Water ejected from the jet pump 11A is directed through a venturi 11B which further accelerates the water to provide additional thrust. The accelerated water jet is ejected from the venturi 11B via a pivoting steering nozzle 110 which is directionally controlled by the driver with a steering mechanism 19 to provide a directionally controlled jet of water to propel and steer the PWC 10.

The electric drive system 20 of the PWC 10 includes one or more of the electric motors 16 (referred hereinafter in the singular) drivingly coupled to the impeller 15 via a drive shaft 28. The drive shaft 28 transfers motive power from the electric motor 16 to the impeller 15. The electric drive system 20 also includes the batteries 18 (referred hereinafter in the singular) for providing electric current to the electric motor 16 and driving the electric motor 16. The operation of the electric motor 16 and the delivery of drive current to the electric motor 16 may be controlled by a controller 32 based on an actuation by the driver of an accelerator 34, sometimes referred to as a "throttle", on the steering mechanism 19, among other inputs. Another example of an input from the steering mechanism 19 is a trim input 19T. The trim input 19T may be any dedicated lever, switch, button or other tactile input which may be selected by the operator to adjust a trim of the steering nozzle 110 of the jet propulsion system 11, thereby allowing for directionally orienting the jet of water expelled from the steering nozzle 11C upward or downward. In some embodiments, the battery 18 may be a lithium ion or other type of battery 18. In various embodiments, the electric motor 16 may be a permanent magnet synchronous motor or a brushless direct current motor for example. In an embodiment, the drive system 20 is non-electric or only partially electric, such that the drive system 20 is or includes a combustion drive system including an internal combustion engine and fuel tank, for example.

Referring to FIG. 1, the PWC 10 moves along a rear or aft direction of travel 36 and along a forward direction of travel 38. The forward direction of travel 38 is the direction along which the PWC 10 travels in most instances when displacing. The aft direction of travel 36 is the direction along which the PWC 10 displaces only occasionally, such as when it is reversing. The PWC 10 includes a bow 31A and a stern 31B defined with respect to the aft and forward directions of travel 36,38, in that the bow 31A is positioned ahead of the stern 31B relative to the forward direction of travel 38, and that the stern 31B is positioned astern of the bow 31A relative to the aft direction of travel 36. The PWC 10 defines a longitudinal center axis 33 that extends between the bow 31A and the stern 31B. A port side 35A and a starboard side 35B of the PWC 10 are defined on opposite lateral sides of the center axis 33. The positional descriptors "front", "aft" and "rear" and terms related thereto are used in the present disclosure to describe the relative position of components of the PWC 10. For example, if a first component of the PWC 10 is described herein as being in front of, or forward of, a second component, the first component is closer to the bow 31A than the second component. Similarly, if a first component of the PWC 10 is described herein as being aft of, or rearward of, a second component, the first component is closer to the stern 31B than the second component. The PWC 10 also includes a three-axes frame of reference that is displaceable with the PWC 10, where the Y-axis is parallel to the vertical direction, the X axis is parallel to the center axis 33, and the Z-axis is perpendicular to both the X and Y axes and defines a lateral direction between the port and starboard sides 35A,35B. Features and components are described and shown in the present disclosure in relation to the PWC 10, but the present disclosure may also be applied to different types of watercraft 10, such as other boats or other vessels, used to transport people and/or cargo.

Figure 2A:
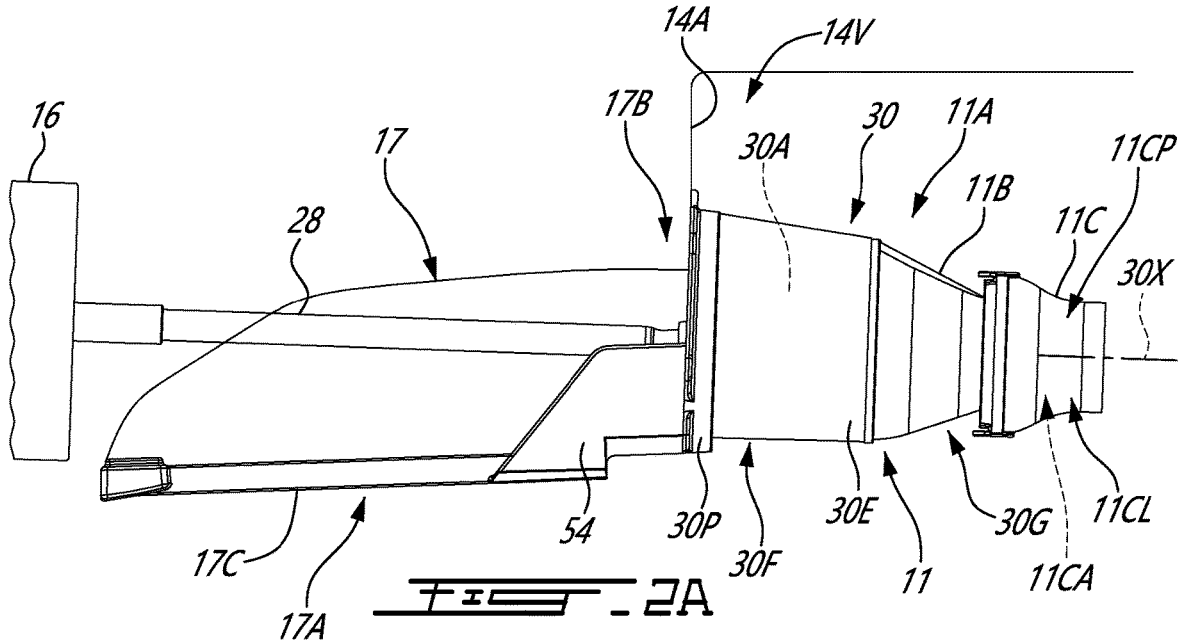
FIG. 2A is a side elevational view of a jet propulsion system of the watercraft of FIG. 1.
Figure 2B:
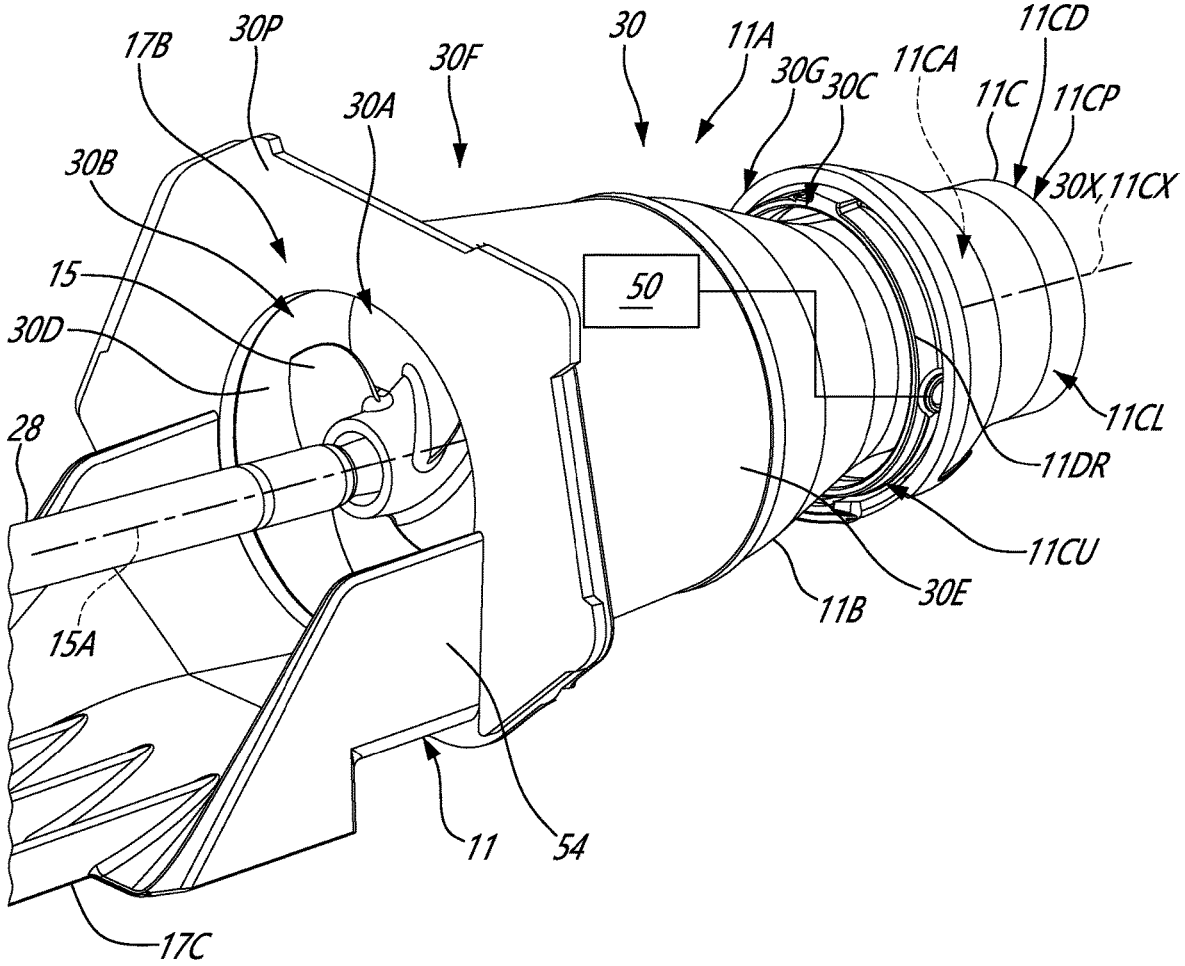
FIG. 2B is a rear perspective view of the jet propulsion system of FIG. 2A.

Referring to FIGS. 2A and 2B, the jet propulsion system 11 includes at least the water intake 17 and the jet pump 11A. The jet pump 11A includes the impeller 15, stator vanes, the venturi 11B (sometimes referred to as a nozzle) and the pivoting steering nozzle 11C. The jet pump 11A has, or is formed by, a housing 30 (sometimes referred to in this specification as the "jet pump housing"). The housing 30 is a hollow body which delimits a housing interior 30A or cavity. The housing interior 30A contains the impeller 15 and the stator vanes. In some embodiments, the housing 30 forms the venturi 11B. Alternatively, the venturi 11B may be a component separate from the housing 30. The housing 30 is an elongated body which extends between an inlet 30B through which the water enters the interior 30A via the water intake 17, and an outlet 30C through which the water is expelled from the housing interior 30A by the impeller 15. The inlet 30B of the housing 30 is in fluid communication, or coincident, with the water intake outlet 17B of the water intake 17. The housing 30 is a stationary component whose position with respect to the hull 14 is fixed, and which moves with the PWC 10 through the water. Referring to FIGS. 2A and 2B, the housing 30 is fixed in position by being mounted to the internal rear wall 14A of the hull 14 within a jet pump tunnel 14V formed along an underside of the hull 14. Some or all of the housing 30 may be partly or completely submerged in water during one or more operating phases of the PWC 10. For example, when the PWC 10 is floating in the water or travelling at relatively low speeds through the water in the forward direction, some or all of the housing 30 may be partly or completely submerged in the water.

The housing interior 30A of the housing 30 is delimited by an inner wall 30D. In the exemplary illustrated embodiment where the housing 30 is an annular body that defines a housing center axis 30X, the inner wall 30D is an annular body with a circumferential surface. The inner wall 30D (sometimes referred to as a "wear ring") may be a component which experiences wear and which may be replaced. The housing 30 has an outer wall 30E that is spaced radially outwardly from the inner wall 30D. The outer wall 30E defines the external surface of the housing 30 and may be submerged in water during one or more operating phases of the PWC 10, such as when the PWC 10 is floating or travelling at relatively low forward speeds. Thus, both the inner wall 30D and the outer wall 30E are configured to be exposed to water during one or more operating phases of the PWC 10. More specifically, the water may flow through the housing interior 30A and thus along or against the inner wall 30D when the PWC 10 is being used, and the outer wall 30E may be partly or completely submerged in water when the PWC 10 is being used. A thickness of the housing 30 may be defined as the distance separating the inner wall 30D from the outer wall 30E, when measured along a line that is normal to aligned surfaces of the inner and outer walls 30D,30E, or when measured along a line that is radial to the housing center axis 30X of the cylindrical housing 30.

The housing 30 encloses or houses the impeller 15 and other components such as stator vanes. The impeller 15 is positioned within the housing interior 30A and is rotatable about an impeller axis 15A to pressurize the water and convey it through the housing 30. The impeller axis 15A is coaxial with the housing center axis 30X. The rotation of the impeller 15 functions to draw the water into the housing interior 30A via the inlet 30B and to expel the water from the outlet 30C, when the PWC 10 is travelling in the forward direction. Referring to FIG. 2B, the impeller 15 is positioned axially between the inlet 30B and the outlet 30C of the housing 30, relative to the impeller axis 15A and the housing center axis 30X. The impeller 15 may be positioned elsewhere with respect to the inlet and outlet 30B,30C. For example, in an alternate embodiment, the impeller 15 is positioned at the inlet 30B. In another possible embodiment, the impeller 15 is positioned at the outlet 30C.

Referring to FIGS. 2A and 2B, the housing 30 includes an upstream portion 30F and a downstream portion 30G. During forward travel of the PWC 10, the water flows through the housing interior 30A of the housing 30 from the upstream portion 30F to the downstream portion 30G. In an embodiment, an example of which is shown in FIGS. 2A and 2B, the upstream and downstream portions 30G,30F are integral with one another and form a one-piece or monolithic housing 30. In an alternate embodiment, the upstream portion 30F is mounted to the downstream portion 30G, such that the upstream and downstream portions 30G,30F form two separate components which make up the housing 30. The inlet 30B of the housing 30 is defined in the upstream portion 30F, and the outlet 30C is defined in the downstream portion 30G. Referring to FIGS. 2A and 2B, the upstream portion 30F has an internal diameter which remains substantially constant along a length of the upstream portion 30F defined along the housing center axis 30X. Referring to FIGS. 2A and 2B, the downstream portion 30G has an internal diameter which decreases along a length of the downstream portion 30G defined along the housing center axis 30X, such that the downstream portion 30G narrows in diameter or converges toward the outlet 30C. The downstream portion 30C thus forms the venturi 11B. Referring to FIGS. 2A and 2B, the housing 30 forms or defines a volume or body which narrows along its axial length from the inlet 30B to the outlet 30C. Other shapes for the upstream and downstream portions 30F,30G are possible.

Referring to FIG. 2B, the pivoting steering nozzle 110 (sometimes referred to herein simply as the "steering nozzle 110") is a hollow annular body which defines a nozzle center axis 11CX and delimits a nozzle interior 11CA or cavity. The water expelled from the outlet 30C of the housing 30 is received in the nozzle interior 11CA via the outlet 30C of the housing 30. The annular body of the steering nozzle 110 includes an upper portion 11CP and a lower portion 11CL positioned beneath the upper portion 11CP. Referring to FIGS. 2A and 2B, the upper and lower portions 11CP,11CL are upper and lower halves of the steering nozzle 110, respectively, which each form a semi-cylindrical shape. In an embodiment, the upper portion 11CP is defined above a horizontal plane including the nozzle center axis 11CX, and the lower portion 11CL is defined beneath the horizontal plane including the nozzle center axis 11CX. The steering nozzle 110 is an elongated body which extends axially along the nozzle center axis 11CX between an upstream end 11CU and a downstream end 11CD positioned astern of the upstream end 11CU. Referring to FIG. 2B, the steering nozzle 110 is pivotably mounted to the housing 30 adjacent to the outlet 30C of the housing 30. The steering nozzle 110 is pivotably mounted to the housing 30 and is positioned at least partially downstream of the outlet 30C. By "at least partially downstream", it is understood that some or all of the steering nozzle 110 is located more astern than the outlet 30C of the housing 30. For example, and referring to FIG. 2B, the upstream end 11CU of the steering nozzle 110 is located forward of the outlet 30C and the downstream end 11CD is located astern of the outlet 30C. In an alternate embodiment, all of the axial length of the steering nozzle 110 measured between the upstream and downstream ends 11CU, 11CD is astern of the outlet 30C. In an alternate embodiment, the steering nozzle 110 is spaced axially apart from the outlet 30C of the housing 30, such that there is at least one other component positioned axially between the outlet 30C and the steering nozzle 110.

The steering nozzle 110 is configured to pivot relative to the housing 30 in order to directionally control the jet of water expelled from the downstream end 11CD of the steering nozzle 11C, and thus propel and steer the PWC 10. One possible pivoting movement of the steering nozzle 11C allows for adjusting a "trim" of the steering nozzle 11C. The trim of the steering nozzle 110 refers to the vertical angle formed between the nozzle center axis 11CX and the housing center axis 30X. The trim of the steering nozzle 110 may be adjusted by pivoting the steering nozzle 110 vertically relative to the housing 30 about a pivot axis that is substantially horizontal and transverse to the housing center axis 30X. The trim movement of the steering nozzle 110 allows for directionally orienting the jet of water expelled from the downstream end 11CD of the steering nozzle 110 upward or downward, thereby adjusting the running angle of the PWC 10. For example, trimming the steering nozzle 110 upward (i.e. orienting the downstream end 11CD upward) helps to push the bow 31A of the PWC 10 upward and allows for the PWC 10 to travel faster. Conversely, trimming the steering nozzle 11C downward (i.e. orienting the downstream end 11CD downward) helps to push the bow 31A of the PWC 10 into the water which may allow for better navigation of the PWC 10. In an embodiment, the steering mechanism 19 includes a dedicated input, such as the trim input 19T, which is configured to send a trimming signal to the controller 32 of the PWC 10 to trim the steering nozzle 110. In an embodiment, the steering mechanism 19 is free of a dedicated trim input, such that the steering nozzle 110 is trimmed automatically in response to another operator input, or in response to an operating mode of the PWC 10.

The steering nozzle 110 has trim limits. The trim limit may be defined as the maximum trim angle defined between the nozzle center axis 11CX and the housing center axis 30X that may be achieved by vertically pivoting the steering nozzle 11C relative to the housing 30. For example, an upper trim limit may be the maximum angle that can be achieved by trimming the steering nozzle 110 upward through a range of angular positions, and the lower trim limit may be the maximum angle that can be achieved by trimming the steering nozzle 110 downward through another range of angular positions. The trim limit may thus be understood as a position of the steering nozzle 110 relative to the housing 30 at which further trim displacement of the steering nozzle 110 relative to the housing 30 is no longer possible. The trim limit for the steering nozzle 110 may result from mechanical limitations or a programmed stop which constrain the movement of the steering nozzle 110 relative to the housing 30.

Alternatively, the steering nozzle 110 may pivot upwards and/or downwards beyond a trim limit. In some embodiments, as discussed elsewhere herein, displacing the steering nozzle 110 beyond a trim limit may engage a reverse function of the jet propulsion system 11.

Another possible pivoting movement of the steering nozzle 110 allows for steering the PWC 10. In this steering pivoting movement, the steering nozzle 110 pivots horizontally relative to the housing 30 about a pivot axis that is substantially upright and transverse to the housing center axis 30X. The lateral movement of the steering nozzle 110 allows for directionally orienting the jet of water expelled from the downstream end 11CD of the steering nozzle 110 toward the port side 35A or toward the starboard side 35B, thereby allowing the PWC 10 to be steered toward the left or the right. In an embodiment, an example of which is shown in FIGS. 2A and 2B, the steering nozzle 110 is capable of both trim and steering pivoting movement.

Various mechanisms are possible to allow the steering nozzle 110 to pivot relative to the housing 30. One example of such a mechanism is shown in FIGS. 2A and 2B. The jet propulsion assembly 11 includes a pivot ring 11DR that is mounted to the steering nozzle 110. Referring to FIG. 2B, the pivot ring 11DR is positioned at the upstream end 11CU of the steering nozzle 110. Referring to FIG. 2B, the pivot ring 11DR is positioned at a similar axial position as the outlet 30C of the housing 30. The pivot ring 11DR is displaceable in order to cause pivoting displacement of the steering nozzle 11C to provide the directionally controlled jet of water to propel and steer the PWC 10. The pivot ring 11DR may sometimes be referred to as a "trim" ring because it allows for adjusting the trim of the steering nozzle 110. The pivot/trim ring 11DR may also facilitate the lateral pivoting movement of the steering nozzle 110 to achieve steering, as described above. The jet propulsion assembly 11 includes one or more actuator(s) 50 which are configured to exert a force against the pivot ring 11DR so that the pivot ring 11DR can pivotably displace the steering nozzle 110. The one or more actuator(s) 50 (occasionally referred to herein in the singular for convenience) is shown schematically in FIG. 2B, and can include any suitable configuration. For example, the actuator 50 may be a linear actuator which exerts a force against the pivot ring 11DR along a linear direction. Alternatively, the actuator 50 may output a rotational drive to the pivot ring 11DR. The actuator 50 may be connected directly or indirectly to the pivot ring 11DR, and may include gearing or other force-transferring bodies. The actuator 50 may be an electric, hydraulic or pneumatic force-exerting device.

It may sometimes be desirable to cause the PWC 10 to reverse, i.e. to cause the PWC 10 to travel in the aft direction of travel 36. It may sometimes be desirable to slow the PWC 10 as it moves in the forward direction of travel 38 by applying controlled braking to the PWC 10.

One possible technique for achieving these functions involves reversing the direction of rotation of the impeller 15 about the impeller axis 15A so as to reverse the flow of water through the steering nozzle 110 and through the housing 30 (i.e. the water flows from the downstream end 11CD of the steering nozzle 110 to the inlet 30B of the housing 30). While this reversal of flow through the jet propulsion system 11 will cause the PWC 10 to move in the aft direction of travel 36, and will cause the PWC travelling in the forward direction of travel 38 to slow down, it may be difficult to steer the PWC 10 using this technique with the pivoting abilities of the steering nozzle 110 described above.

Another possible technique for causing the PWC 10 to reverse and to respond to controlled braking involves maintaining the normal direction of water flowing through the housing 30 and nozzle 110 (i.e. the water flows from the inlet 30B of the housing 30 to the downstream end 11CD of the steering nozzle 110) and intercepting, diverting, redirecting or engaging this flow with another component of the jet propulsion system 11. This component of the jet propulsion system 11 is referred to herein as a deflector gate 40 and is now described in greater detail.

Figure 3A:
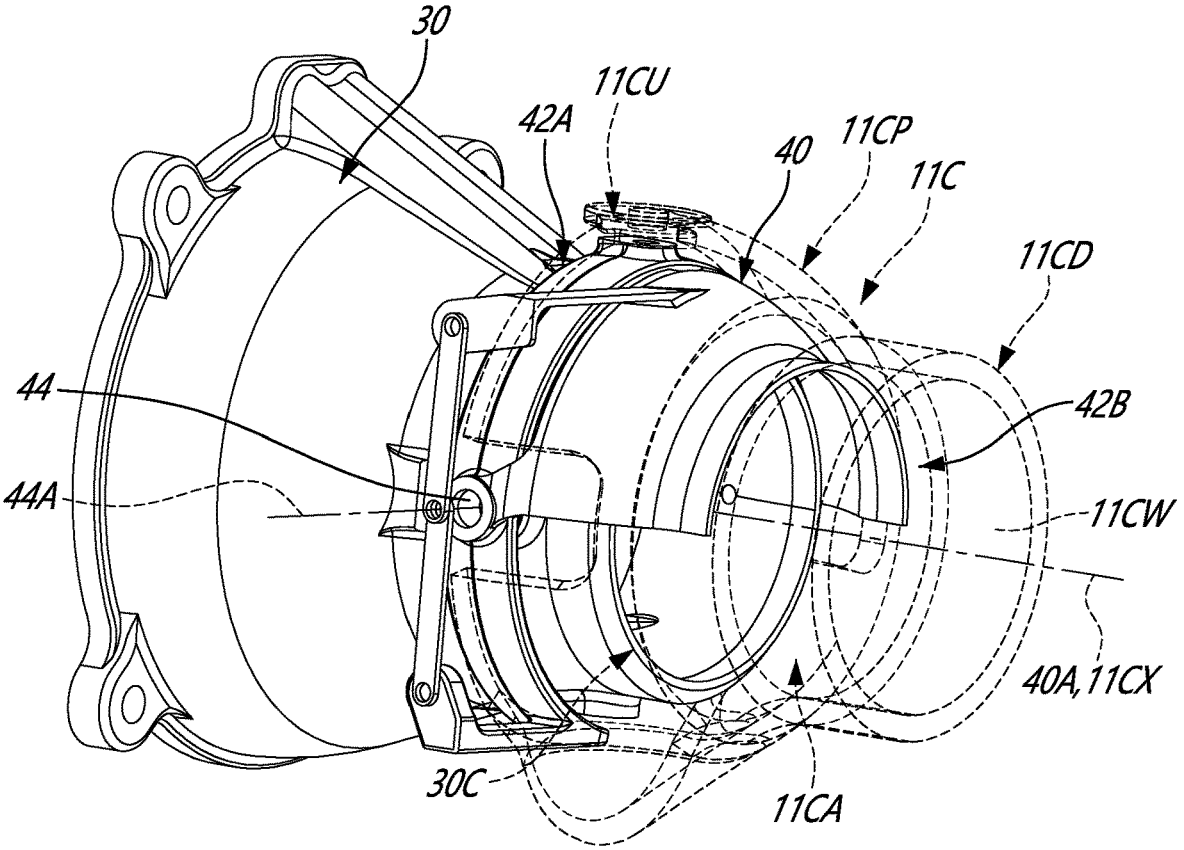
FIG. 3A is a perspective view of a housing, a steering nozzle, and a deflector gate of the jet propulsion assembly of FIG. 2A.
Figure 3B:
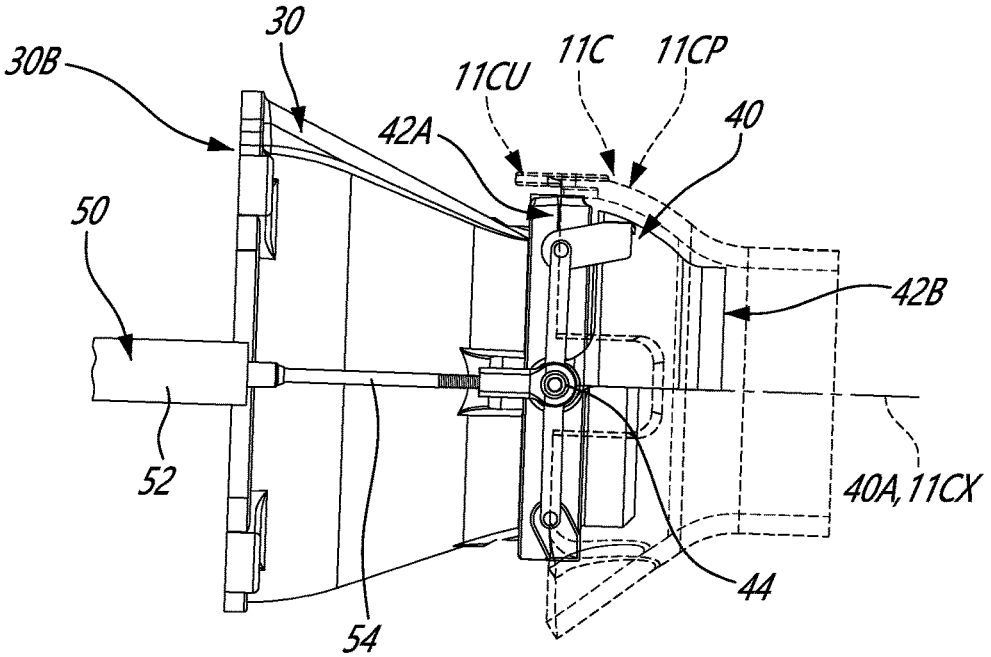
FIG. 3B is a side elevational view of what is shown in FIG. 3A.

Referring to FIGS. 3A and 3B, the deflector gate 40 is located within the nozzle interior 11CA. In this location, the deflector gate 40 is able to engage the water flowing through the nozzle interior 11CA, and to direct the water in an upstream direction to cause the PWC 10 to slow down (i.e. decrease its speed in the forward travel direction 38), or to reverse direction (and move in the aft direction of travel 36), as described in greater detail below. The deflector gate 40 may thus be any body or device which achieves this function of flow diversion within the steering nozzle 110. It will thus be appreciated that the term "gate" does not limit the configuration or form of the deflector gate 40. Other expressions or descriptors which may be substituted for deflector gate 40 include, but are not limited to, "deflector", "flow diverter", "reverse thrust device", "reverse gate", and "flow guide body". Referring to FIGS. 3A and 3B, the deflector gate 40 is completely enclosed by an annular, circumferential nozzle inner wall 11CW which defines the nozzle interior 11CA, and by the body of the steering nozzle 110. The deflector gate 40 may thus be described as an "in-nozzle" deflector gate 40 which engages the water flowing through the steering nozzle 110 in some configurations, as described in greater detail below.

The deflector gate 40 may have any suitable form, shape or configuration to achieve the functions ascribed to the deflector gate 40 herein. For example, and referring to FIGS. 3A and 3B, the deflector gate 40 is an elongated body extending between a first end 42A and a second end 42B spaced apart from the first end 42A. The first end 42A is positioned closer to inlet 30B of the housing 30 than the second end 42B. The first end 42A is positioned forward of the second end 42B. In the configuration of the deflector gate 40 shown in FIGS. 3A and 3B, the deflector gate 40 has a partially-cylindrical shape. The deflector gate 40 is a hollow, partially-cylindrical body defined about a deflector gate center axis 40A. In an embodiment, an example of which is shown in FIGS. 3A and 3B, the deflector gate 40 has a shape that is less than a full revolution about the deflector gate center axis 40A. In an embodiment, an example of which is shown in FIGS. 3A and 3B, the deflector gate 40 has a semi-cylindrical shape. The shape of the deflector gate 40 may also or instead be referred to as partially-conical, partially-annular and/or partially-circumferential. The partially-cylindrical shape of the deflector gate 40 and the cylindrical shape of the steering nozzle 110 have a common or shared axis in the example shown in FIGS. 3A and 3B. The deflector gate center axis 40A and the nozzle center axis 11CX are collinear when the deflector gate 40 has the position shown in FIGS. 3A and 3B (other positions are possible, as explained in greater detail below). The partially-cylindrical shape of the deflector gate 40 tapers radially inwardly. Referring to FIGS. 3A and 3B, the radius of the deflector gate 40, measured from the deflector gate center axis 40A, decreases over the axial length of the deflector gate 40 from the first end 42A to the second end 42B. Referring to FIGS. 3A and 3B, the radius of the deflector gate 40, measured from the deflector gate center axis 40A, is larger at the first end 42A than it is at the second end 42B. In the configuration of the steering nozzle 110 shown in FIGS. 3A and 3B, the radially-inward taper of the deflector gate 40 in the downstream direction helps the deflector gate 40 to conform to the shape of the nozzle inner wall 11CW of the upper portion 11CP of the steering nozzle 110 with which it is flush when the deflector gate 40 has the position shown in FIGS. 3A and 3B. Other shapes for the deflector gate 40 are possible, and examples of different shapes are described in greater detail below. The deflector gate 40 may be formed from a rigid material such as metal and/or plastic, for example.

The deflector gate 40 is displaceable relative to the steering nozzle 110 in which it is positioned. More particularly, the deflector gate 40 is pivotable relative to the steering nozzle 110 about a pivot axis 44A defined by a pivot 44. The pivot 44 is a stand-alone structure or part of a component like a hinge. The deflector gate 40 is mounted to the steering nozzle 110 by the pivot 44. In an embodiment, an example of which is shown in FIGS. 3A and 3B, the deflector gate 40 is mounted to the steering nozzle 110 at two pivots 44 laterally spaced apart, or spaced apart along the pivot axis 44A. In an embodiment, an example of which is shown in FIGS. 3A and 3B, the steering nozzle 110 is mounted to the housing 30 at the same pivot 44. The pivot 44 is positioned at, or closest to, the upstream first end 42A of the deflector gate 40. The pivot 44 is positioned at, or closest to, the upstream end 11CU of the steering nozzle 110 or adjacent to the outlet 30C of the housing 30. Referring to FIGS. 3A and 3B, the pivot axis 44A has a substantially horizontal orientation that is transverse to the nozzle center axis 11CX, such that the deflector gate 40 is able to pivot up and down relative to the steering nozzle 110. In an embodiment, an example of which is shown in FIGS. 3A and 3B, the deflector gate 40 only pivots up and down relative to the steering nozzle 110.

The deflector gate 40 is pivotable relative to the steering nozzle 110 between a default position and a deflector position, and through all the possible positions between the default and deflector positions. In the default position, an example of which is shown in FIGS. 3A and 3B, the deflector gate 40 is not engaging the flow of water through the nozzle interior 11CA in any substantial way, such that the water is able to flow from the upstream end 11CU to the downstream end 11CD of the steering nozzle 110 without being disturbed or redirected by the deflector gate 40. In this way, the jet propulsion system 11 may generate thrust to propel the PWC 10 in the forward direction of travel 38. The deflector gate 40 may be flush with the nozzle inner wall 11CW of the upper portion 11CP of the steering nozzle 110. The deflector gate 40 is in the "through-flow" default position during most operating phases of the PWC 10, such as when the PWC 10 is floating or travelling at forward speeds without braking. In the default position, and as shown in FIGS. 3A and 3B, the second end 42B of the deflector gate 30 is located downstream of the first end 42A. In the default position, and as shown in FIGS. 3A and 3B, the deflector gate center axis 40A is substantially collinear with the nozzle center axis 11CX.

Figure 3C:
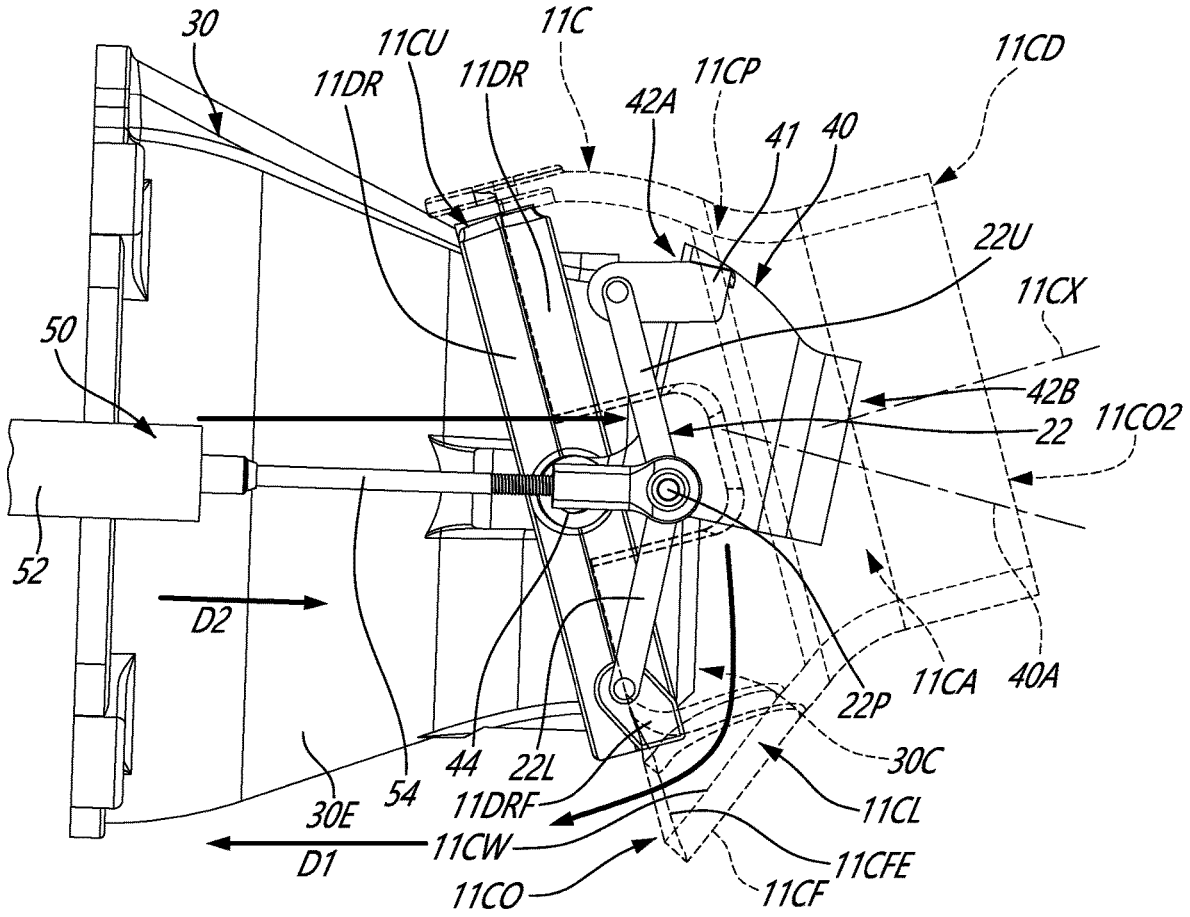
FIG. 3C is another side elevational view of what is shown in FIG. 3A.

In the deflector position, an example of which is shown in FIG. 3C, the deflector gate 40 is engaging the flow of water through the nozzle interior 11CA, such that the water is partially or fully prevented from flowing toward the downstream end 11CD of the steering nozzle 110 and is diverted out of the steering nozzle 11C. The deflector gate 40 is in the deflector position occasionally, such as when it is desired to reverse the PWC 10 or to more fully control its deceleration (i.e. braking). In the deflector position, and as shown in FIG. 3C, the second end 42B of the deflector gate 30 is still located downstream of the first end 42A, but the first end 42A has moved aft and the second end 42B has moved forward, compared to the their locations in the default position. In the deflector position, and as shown in FIG. 3C, the deflector gate center axis 40A is transverse to, or misaligned from, the nozzle center axis 11CX.

In the deflector position, and referring to FIG. 3C, the deflector gate 40 intercepts the water flowing through the nozzle interior 11CA and deflects, diverts, or redirects some or all of the water in an upstream direction D1 out of an opening 1100 in the steering nozzle 110. The upstream direction D1 is understood to be opposite to the downstream direction D2 along which the water flows through the nozzle interior 11CA from the upstream end 11CU to the downstream end 11CD. By diverting some or all of the flow through the steering nozzle 110 in the forward or upstream direction D1, the flow diverter 40 in the "reverse-flow" deflector position is able to generate a reverse thrust which can cause the PWC 10 to displace in the aft travel direction 36, and/or which will cause the PWC 10 to decrease its speed in the forward travel direction 38.

The opening 1100 is distinct and separate from a second opening 11002 of the steering nozzle 11C formed at the downstream end 11CD, through which the water is ejected from the steering nozzle 110 to generate forward thrust for the PWC 10. The opening 1100 is axially spaced apart from the second opening 11002 as measured along the nozzle center axis 11CX. The opening 1100 may thus be considered a first, upstream opening 1100 of the steering nozzle 110, and the second opening 11002 may be considered to be a downstream opening of the steering nozzle 110.

As explained in greater detail below, in the configuration of the steering nozzle 110 shown in FIGS. 3A to 3C, the opening 1100 is formed when the steering nozzle 110 is trimmed relative to the housing 30. Referring to FIG. 3C, the opening 1100 is formed by trimming the steering nozzle 110, i.e. pivoting it vertically, relative to the housing 30. Referring to FIG. 3C, the steering nozzle 110 is shown trimmed upwardly, which creates a space along the upstream end 11CU of the lower portion 11CL of the steering nozzle 110 and defines the opening 1100 through which water is deflected by the deflector gate 40 in the deflector position.

The opening 1100 may take many forms. For example, and referring to FIG. 3C, the opening 1100 is located at the bottom of the steering nozzle 110, in the lower portion 11CL. This allows the flow of water deflected or diverted by the deflector gate 40 to be directed in a downward direction, which may facilitate steering of the PWC 10. The water deflected downward will still have a direction component vector that is parallel to, and oriented towards, the upstream direction D1. In an alternate embodiment, the opening is formed in the top of the steering nozzle 110, such as in the upper portion 11CP, so that the flow of water deflected or diverted by the deflector gate 40 out of the steering nozzle 110 is in an upward direction. Other shapes or forms for the opening 1100 are possible, and at least one other example is provided below. Referring to FIG. 3C, the opening 1100 is part of a through passage that is defined between the nozzle inner wall 11CW and the outer wall 30E of the housing 30. The opening 1100 is defined between the nozzle inner wall 11CW at the upstream end 11CU of the steering nozzle 110, and the outer wall 30E adjacent to the outlet 30C of the housing 30.

The lower portion 11CL may be configured to define the shape of the opening 1100 after the steering nozzle 110 has been trimmed. For example, and referring to FIG. 3C, the lower portion 11CL of the steering nozzle 110 has or defines a flow guide 11CF. The flow guide 11CF is a portion of the lower portion 11CL which helps to guide the flow of water deflected by the deflector gate 40, and which delimits part of the opening 11CO. In the example of the flow guide 11CF shown in FIG. 3C, the flow guide 11CF is in the form of a spout. The flow guide 11CF includes a curved edge 11CFE along a radially-protruding portion of the lower portion 11CL at the upstream end 11CU (see FIG. 3I). The curvature of the curved edge 11CFE is different from the curvature of a remainder of the lower portion 11CL at the upstream end 11CU. The flow guide 11CF is a portion of the lower portion 11CL at the upstream end 11CU which protrudes radially outwardly more than other portions of the lower portion 11CL at the upstream end 11CU. The flow guide 11CF is shaped to help the water deflected by the deflector gate 40 to flow in the first direction D1 so that the steering nozzle 110 can generate a reverse thrust. The angle formed by the flow guide 11CF may be selected so that the water flowing out of the opening 1100 is oriented so as to flow underneath, and bypass, other components of the PWC 10, such as a ride plate. Irrespective of its shape, it will be appreciated that the opening 1100 helps to direct water forwards when the steering nozzle 110 is trimmed and the deflector gate 40 is in the deflector position.

Referring to FIG. 3C, the pivoting movement of the steering nozzle 11C and of the deflector gate 40 is achieved with the one or more actuator(s) 50 of the jet propulsion system 11. The one or more actuator(s) 50 are configured to exert a force against the pivot ring 11DR so that the pivot ring 11DR can trim the steering nozzle 110. Referring to FIG. 3C, the actuator 50 is a linear actuator which exerts a force against a linkage 22 of the jet propulsion system 11. The linear actuator 50 has a housing 52 from which a rod or other end effector 54 extends, and into which at least part of the end effector 54 retracts. The linkage 22 is connected to the pivot ring 11DR and to the deflector gate 40. The linkage 22 is a two-bar linkage which includes an upper link 22U, a lower link 22L, and a linkage pivot 22P at which the upper and lower links 22U,22L are pivotably connected. The end effector 54 of the actuator 50 is configured to exert a linear force against the linkage pivot 22P. An upper end of the upper link 22U is pivotably connected to a flange 41 of the deflector gate 40, and lower end of the lower link 22L is pivotable connected to a flange 11DRF of the pivot ring 11DR.

Figure 3D:
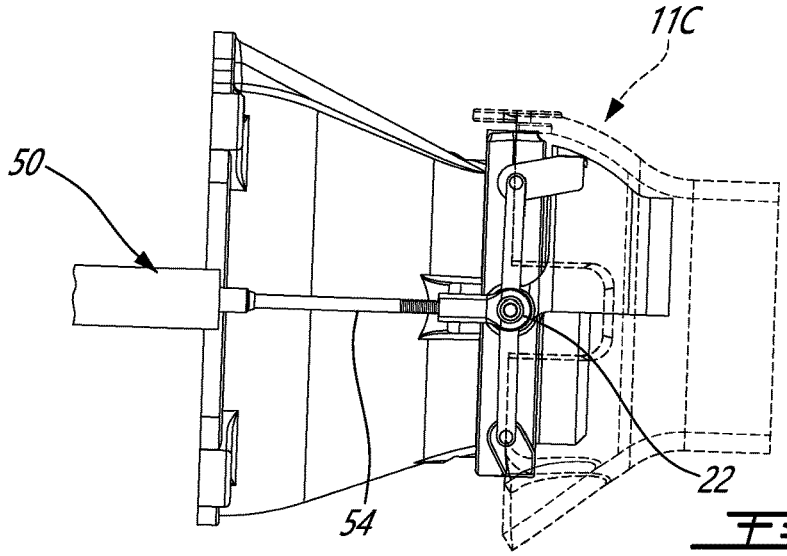
FIGS. 3D to 3F are more side elevationals view of what is shown in FIG. 3A.
Figure 3E:
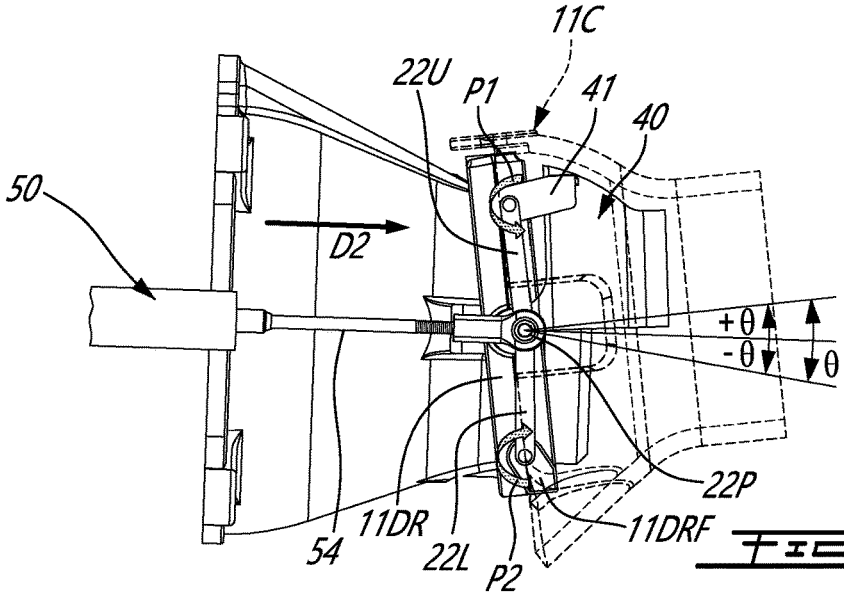
Figure 3F:
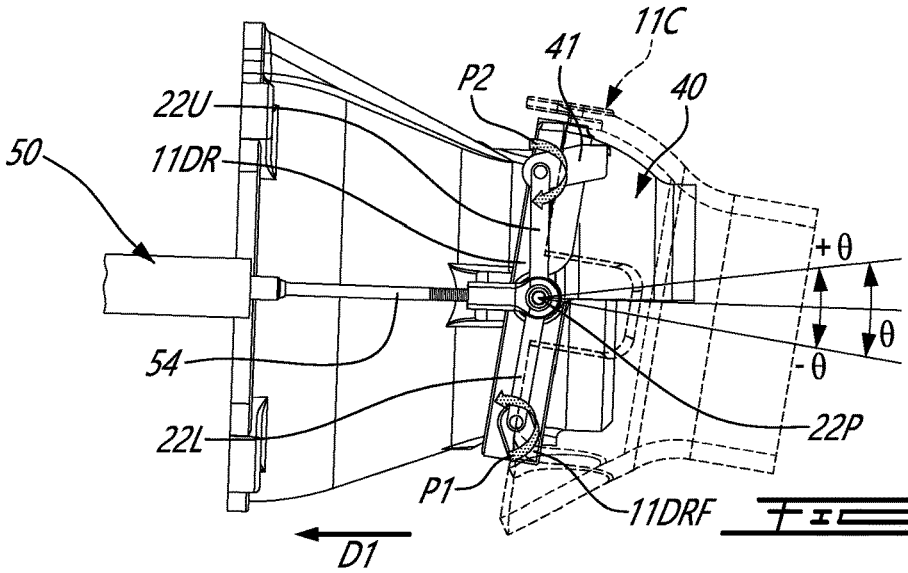

Referring to FIGS. 3D to 3F, the pivoting movement of the steering nozzle 11C is achieved as follows. As shown in FIG. 3D, the end effector 54 of the actuator 50 is exerting no force on the linkage pivot 22P, such that the steering nozzle 11C remains in the untrimmed position shown. To trim the steering nozzle 110 upward, and as shown in FIG. 3E, the end effector 54 of the actuator 50 exerts a pushing linear force against the linkage pivot 22P in a direction toward the right of the page (i.e. parallel to the second direction D2). This causes the upper link 22U to pivot in the pivot direction P1 relative to the flange 41 of the deflector gate 40, and causes the lower link 22L to pivot in the pivot direction P2 relative to the flange 11DRF of the pivot ring 11DR. This pivoting movement of the upper and lower links 22U,22L causes the pivot ring 11DR and the steering nozzle 110 to trim upwardly. To trim the steering nozzle 110 downward, and as shown in FIG. 3F, the end effector 54 of the actuator 50 exerts a pulling linear force against the linkage pivot 22P in a direction toward the left of the page (i.e. parallel to the first direction D1). This causes the upper link 22U to pivot in the pivot direction P2 relative to the flange 41 of the deflector gate 40, and causes the lower link 22L to pivot in the pivot direction P1 relative to the flange 11DRF of the pivot ring 11DR. This pivoting movement of the upper and lower links 22U,22L causes the pivot ring 11DR and the steering nozzle 110 to trim downwardly.

Referring to FIGS. 3D to 3F, the actuator 50 is configured to displace the steering nozzle 110 (and the deflector gate 40, as explained below) through a range of actuation. The range of actuation through which the actuator 50 is operable includes a first range portion. When operating in the first range portion of the range of actuation, the actuator 50 functions to displace the steering nozzle 110 to adjust its trim. The first range portion of the actuator 50 may correspond to the trim limits of the steering nozzle 110. This movement of the steering nozzle 110 towards its trim limits may also cause the deflector gate 40 to simultaneously pivot relative to the steering nozzle 110. This movement of the deflector gate 40 in the first range portion of the actuator 50 may be insufficient to displace the deflector gate 40 to the deflector position, such that water is effectively not diverted by the deflector gate 40 in the first range portion of the actuator 50. The trim limit may be defined as the maximum trim angle θ described above. In the convention used in this specification, the angular range leading from no trim to the upper trim limit is positive or "+θ", and the angular range leading from no trim to the lower trim limit is negative or "−θ". The first range portion of the actuator 50 may correspond to the trim limits, such that the linear displacement of the end effector 54 is chosen to maintain the steering nozzle 110 within the upper and lower trim limits in the first range portion. One non-limiting example of an upper trim limit is +8 degrees, meaning that the steering nozzle 110 may be trimmed upward from 0 degrees until +8 degrees. One non-limiting example of a lower trim limit is −8 degrees, meaning that the steering nozzle 110 may be trimmed downward from 0 degrees until −8 degrees.

In embodiments disclosed herein, the actuator 50 is capable of displacing the end effector 54 beyond the first range portion, i.e. beyond the trim limits of the steering nozzle 110. This displacement beyond the first range portion corresponds to a second range portion of the range of actuation of the actuator 50. The second range portion follows the first range portion, and corresponds to a range of displacement of the end effector 54 which results in the actuator 50 causing pivoting displacement of the deflector gate 40, relative to the steering nozzle 11C, toward the deflector position. When the actuator 50 is operating in the second range portion of the range of actuation, the steering nozzle 11C has already reached its trim limit. When the actuator 50 is operating in the second range portion of the range of actuation, the steering nozzle 11C continues to displace relative to the housing 30 in the vertical direction, and the deflector gate 40 pivots downwardly relative to the steering nozzle 110 toward the deflector position. It will thus be appreciated that, in at least one embodiment of the steering nozzle 110 and deflector gate 40 disclosed herein, the actuator 50 functions to first displace the steering nozzle 110 to its trim limit (upper or lower trim limit), and then functions to continue exerting force to subsequently displace both the steering nozzle 110 and the deflector gate 40 to the deflector position. The deflector gate 40 is therefore caused to pivot to the deflector position by displacement of the steering nozzle 110 in the vertical direction past its trim limit. By actuating the steering nozzle 110 past its trim limit, it is possible to trigger displacement of the deflector gate 40, such that a reverse propulsive thrust is generated out of trim range of the steering nozzle 110. In such an embodiment, the movement of the steering nozzle 110 and the deflector gate 40 is coordinated or sequenced. In an embodiment, the defector gate 40 and the steering nozzle 110 are always in movement through the first and second range portions of the range of actuation of the actuator 50, and the speed of rotation of the deflector gate 40 is less than the speed of rotation of the steering nozzle 110. In an embodiment, the defector gate 40 is continuously moving relative to the steering nozzle 110 through the first and second range portions of the range of actuation of the actuator 50. In an embodiment, the first range portion is defined by trim movement of the steering nozzle 110 within the upper trim limit and/or lower trim limit, and the second range portion is defined by a vertically pivoting motion of the steering nozzle 110 that occurs past its trim limit.

In an embodiment, a single actuator 50 is capable of both trimming the steering nozzle 110 and pivoting the deflector gate 40. In some embodiments, one or more other actuator(s) in addition to the actuator 50 may be implemented and connected to the steering nozzle 11C to cause steering (i.e. lateral) displacement of the steering nozzle 110. The use of only one actuator 50 in the jet propulsion system 11 to both trim the steering nozzle 110 and displace the deflector gate 40 may allow the jet propulsion system 11 to have fewer parts, lower complexity, and lighter weight. Additionally, using only one actuator 50 may require fewer through-holes to be formed in the hull 14 of the PWC 10. The actuator 50 disclosed herein may be the existing nozzle trim actuator of the jet propulsion system 11. In an embodiment, an example of which is shown in FIGS. 3D to 3F, the actuator 50 and its components are positioned outside of the steering nozzle 110 and outside of the deflector gate 40.

This coordinated movement of the steering nozzle 110 and the deflector gate 40 may be achieved in many different ways. One example of such a technique for achieving this coordinated movement of the steering nozzle 110 and the deflector gate 40 is now described with reference to FIGS. 3E and 3G. Referring to FIG. 3E, to trim the steering nozzle 110 upward, the end effector 54 exerts a pushing linear force against the linkage pivot 22P in a direction toward the right of the page (i.e. parallel to the second direction D2). Since the actuator 50 is still operating in the first range portion of the range of actuation (i.e. before reaching the upper trim limit of the steering nozzle 110), the steering nozzle 110 will trim upwardly. Through the first range portion, the deflector gate 40 is caused to begin pivoting downwardly from the default position shown in FIG. 3D, but does not pivot downwardly all the way to the deflector position. Thus, the actuator 50 functioning through the first range portion corresponding to the range of trim angles leading up to the upper trim limit +θ may cause the deflector gate 40 to displace relative to the steering nozzle 110.

Figure 3G:
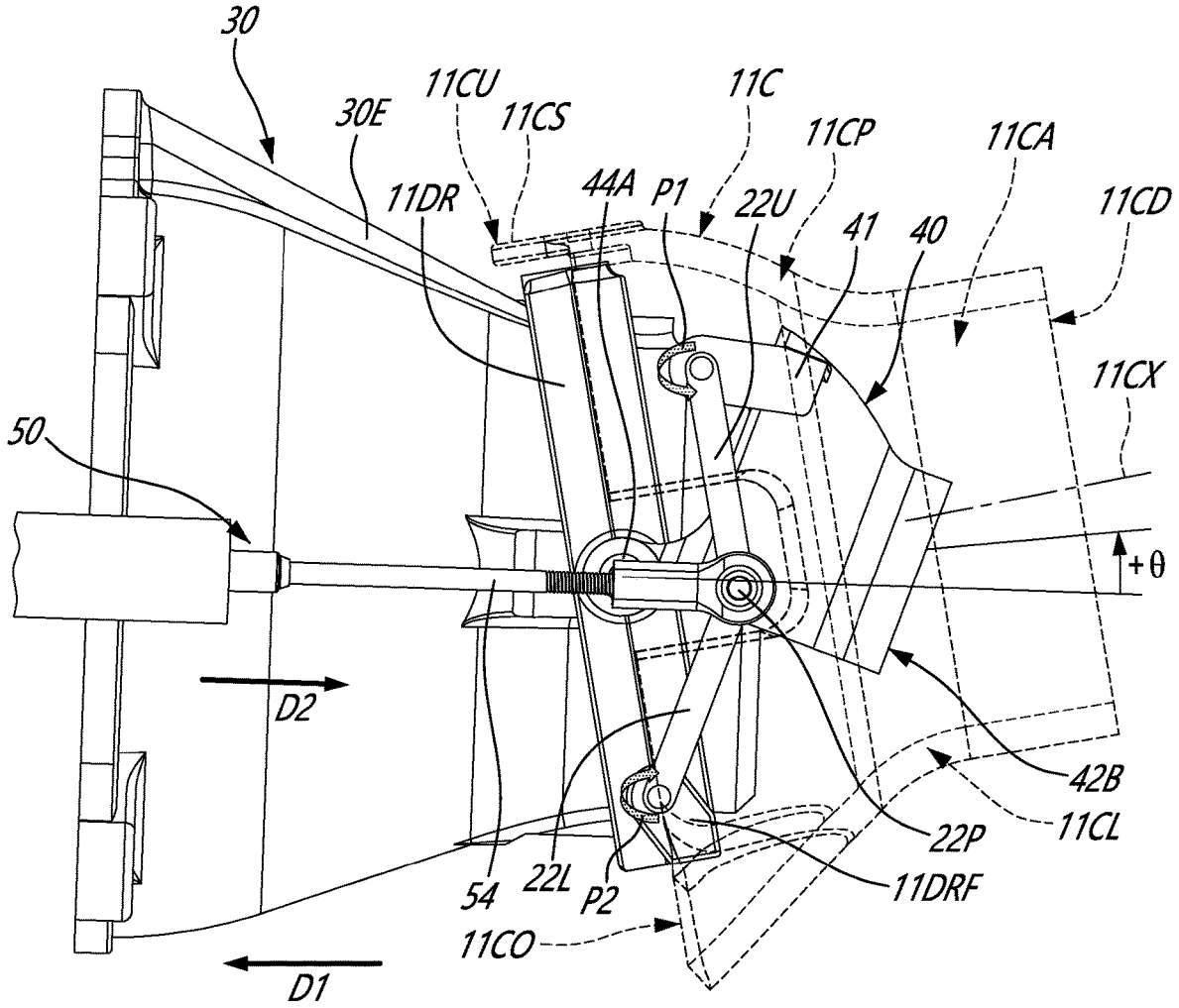
FIG. 3G is another side elevational view of what is shown in FIG. 3A.

The steering nozzle 11C may eventually reach its upper trim limit after having displaced through the range of angular positions leading to the upper trim limit +θ, as shown in FIG. 3G. Once the steering nozzle 110 has reached its upper trim limit, continued operation of the actuator 50 now occurs through the second range portion of the range of actuation. Continued linear displacement of the end effector 54 in the second range portion will cause additional upward pivoting movement of the nozzle 11C, and will also cause the deflector gate 40 to continue pivoting downwardly relative to the steering nozzle 110 to the deflector position shown in FIG. 3G. More particularly, in the second range portion, continued exertion of the pushing force by the end effector 54 against the linkage pivot 22P in the second direction D2 will cause the upper link 22U to pivot further in the pivot direction P1 relative to the flange 41 of the deflector gate 40, and cause the lower link 22L to pivot further in the pivot direction P2 relative to the flange 11DRF of the pivot ring 11DR. This additional pivoting movement of the upper and lower links 22U,22L causes the deflector gate 40 to pivot downwardly about the pivot axis 44A from its location in the upper portion 11CP to the deflector position. Referring to FIG. 3G, at least part of the deflector gate 40, for example some of the second end 42B, is positioned within the lower portion 11CL of the steering nozzle 110 in the deflector position. Since the steering nozzle 110 is trimmed up, the opening 1100 is formed in the lower portion 11CL and the deflector gate 40 functions to divert at least some of the water flowing through the nozzle interior 11CA out of the steering nozzle 110 via its opening 1100 and in the upstream, first direction D1, thereby creating a reverse thrust which may cause the PWC 10 to reverse or to slow its forward speed of travel. Referring to FIG. 3G, the deflector gate 40 vertically spans the upper and lower portions 11CP,11CL of the steering nozzle 110 when deflecting water downward and in the upstream direction. To engage reverse thrust, the deflector gate 40 is actuated downwardly and the steering nozzle 110 is trimmed up. In an embodiment, an example of which is shown in FIG. 3G, the deflector gate 40 is actuated downwardly and the steering nozzle 110 is trimmed up to block the exit of the steering nozzle 11C (i.e. the outlet at the downstream end 11CD) less than fully. In another embodiment, the deflector gate 40 is actuated downwardly and the steering nozzle 110 is trimmed up to fully block the exit of the steering nozzle 11C (i.e. all of the outlet at the downstream end 11CD). For example, the axial length of the deflector gate 40 could be increased to fully block the exit of the steering nozzle 110 in the deflector position.

The coordinated movement of the steering nozzle 11C and the deflector gate 40 through the first and second range portions of the range of actuation of the actuator 50 may allow the jet propulsion system 11 to achieve both controlled braking and reverse functionality. For example, and referring to FIG. 3E, in the first range portion, the steering nozzle 110 is trimmed upward and the deflector gate 40 begins to pivot downwardly relative to the steering nozzle 110 from the default position. Once the steering nozzle 110 arrives at its upper trim limit, the deflector gate 40 has only slightly pivoted downwardly, such that it does not obstruct the exit of the steering nozzle 110, and/or does not generate any significant reverse thrust out of the opening 1100 in the upstream, first direction D1. The deflector gate 40 in this position may thus have no impact on the speed or direction of travel of the PWC 10. Referring to FIG. 3G, in the second range portion, the steering nozzle 110 is pivotable upwardly past its trim limit and the deflector gate 40 is caused to pivot downwardly to the deflector position. The deflector gate 40 in the deflector position is partially or fully obstructing the exit of the steering nozzle 110, and/or generating reverse thrust out of the opening 1100 in the upstream, first direction D1. The deflector gate 40 in the deflector position may thus cause the PWC 10 to decelerate and thus function as a brake. Once the PWC 10 has decelerated sufficiently and ceased travelling in the forward direction of travel 38, the reverse thrust generated by the deflector gate 40 causes the PWC 10 to reverse direction to travel in the aft direction of travel 36. It will be appreciated that the extent of braking provided by the deflector gate 40 can be controlled by adjusting its position relative to the steering nozzle 110 in the second range portion. It will thus be appreciated that the PWC 10 may be caused to first brake by operating the actuator 50 in the second range portion, and once stopped, the PWC 10 may then be caused to travel in the aft direction of travel 36 by also operating the actuator 50 in the second range portion.

Another possible configuration of the coordinated movement of the steering nozzle 110 and the deflector gate 40 through the first and second range portions of the range of actuation of the actuator 50 to allow the jet propulsion system 11 to achieve both controlled braking and reverse functionality is now described. For example, in the first range portion, the steering nozzle 11C is trimmed upward and the deflector gate 40 begins to pivot downwardly relative to the steering nozzle 110 from the default position. Once the steering nozzle 110 arrives at its upper trim limit, the deflector gate 40 has pivoted downwardly such that it only partially obstructs the exit of the steering nozzle 110, and/or such that the deflector gate 40 generates only partial reverse thrust out of the opening 1100 in the upstream, first direction D1. The deflector gate 40 in this position may thus cause the PWC 10 to decelerate, and thus function as a brake. It will be appreciated that the extent of braking provided by the deflector gate 40 can be controlled by adjusting its position relative to the steering nozzle 11C through the first range portion. In the second range portion, the steering nozzle 11C is pivotably upwardly past its trim limit and the deflector gate 40 is caused to pivot downwardly to the deflector position. The deflector gate 40 in the deflector position is more fully obstructing the exit of the steering nozzle 11C, and/or generating more reverse thrust out of the opening 1100 in the upstream, first direction D1. The deflector gate 40 in the deflector position may thus cause the PWC 10 to decelerate harder or to travel in reverse. It will thus be appreciated that the PWC 10 may be caused to first brake by operating the actuator 50 in the first range portion, and once stopped, the PWC 10 may then be caused to travel in the aft direction of travel 36 by operating the actuator 50 in the second range portion.

Continued pivoting displacement of the steering nozzle 110 past the trim limit in the second range portion may cause the upstream end 11CU of the upper portion 11CP of the steering nozzle 110 to contact a physical barrier, which in the illustrated embodiment of FIG. 3G, is the outer wall 30E of the housing 30. In an embodiment, an example of which is shown in FIG. 3G, the steering nozzle 110 has a mechanical stop 11CS configured to abut part of the housing 30 when the steering nozzle 110 is displacing through the second range portion (i.e. after it has reached its trim limit). In the illustrated embodiment, the mechanical stop 11CS is a curved lip having a circumference less than the circumference of the upper portion 11CP, which extends axially upstream away from the upstream end 11CU in a direction parallel to the nozzle center axis 11CX. The nozzle 110 is thus prevented from upwardly trimming further.

In some configurations, it may be possible for the deflector gate 40 to experience some displacement or pivoting while the steering nozzle 110 is trimming in the first range portion, due to the linkage 22 being connected to both the deflector gate 40 and the steering nozzle 110. In such an embodiment, this entrained displacement of the deflector gate 40 may be small enough such that the deflector gate 40 is incapable of substantially deflecting water in the upstream direction, and only does so once the steering nozzle 110 has reached the trim limit. In an alternate embodiment, the deflector gate 40 remains stationary relative to the steering nozzle 110 during some of the range of actuation of the actuator 50. For example, the deflector gate 40 remains stationary relative to the steering nozzle 11C through the first range portion. In another embodiment, the actuator 50 functioning through the first range portion corresponding to the range of trim angles leading up to the upper trim limit +θ may cause no impact on displacement of the deflector gate 40. The steering nozzle 11C may thus be displaced independently of the deflector gate 40 until nozzle 110 reaches the trim limit.

It will be appreciated that the deflector gate 40 may be actuated to decrease the forward travel speed of the PWC 10, i.e. to apply braking to the PWC 10. For example, and referring to FIG. 3G, once the steering nozzle 110 has reached the upper trim limit and the actuator 50 is operating in the second range portion of the range of actuation, the end effector 54 may be displaced to pivot the deflector gate 40 to a position between the default position and the deflector position. In such a position, some water is able to flow through the nozzle interior 11CA and be ejected from the downstream end 11CD to provide the PWC 10 with some forward propulsive thrust, while a remainder of the water is diverted by the deflector gate 40 out of the steering nozzle 11C via the upstream opening 1100 to generate reverse propulsive thrust. The effect of the opposite forward and reverse propulsive thrusts will cause the PWC 10 to decrease and possibly stop its displacement in the forward direction of travel 38. This "partial" position of the deflector gate 40 may also allow for the PWC 10 to reverse and travel in the aft direction of travel 36. The braking or reversing functionality may be selected by the operator of the PWC 10 for example via any suitable input on the steering mechanism 19. Alternatively, at least the braking functionality may come into effect automatically, such as when the operator of the PWC 10 releases the accelerator 34 on the steering mechanism 19.

To further ensure that the PWC 10 is travelling in the aft direction of travel, the deflector gate 40 may be actuated to a "total" deflection position. For example, and referring to FIG. 3G, once the steering nozzle 110 has reached the upper trim limit and the actuator 50 is operating in the second range portion of the range of actuation, the end effector 54 may be displaced to pivot the deflector gate 40 into the deflector position. In one possible configuration of "total" deflection in the deflector position, very little or no water is able to flow through the nozzle interior 11CA and be ejected from the downstream end 11CD such that the PWC 10 is provided with no or insignificant forward propulsive thrust, while all or almost all of the water is diverted by the deflector gate 40 out of the steering nozzle 110 via the upstream opening 1100 to generate reverse propulsive thrust. The effect of the negligible forward propulsive thrust and the comparatively large reverse thrusts will cause the PWC 10 to displace in the aft direction of travel 36.

Whether braking or reversing, the reverse propulsive thrust generated by the deflector gate 40 and the steering nozzle 110 allows the operator to maintain the steering functionality of the PWC 10. Stated differently, the steering mechanism 19 may be used to control the direction of travel of the PWC 10 while the deflector gate 40 is in the deflector position, such that the PWC 10 may be reversed while simultaneously manipulating the steering mechanism 19 to steer the PWC 10. In this manner, the PWC 10 is able to travel in the reverse direction while maintaining steering actuation of the steering nozzle 110.

Figure 3H:
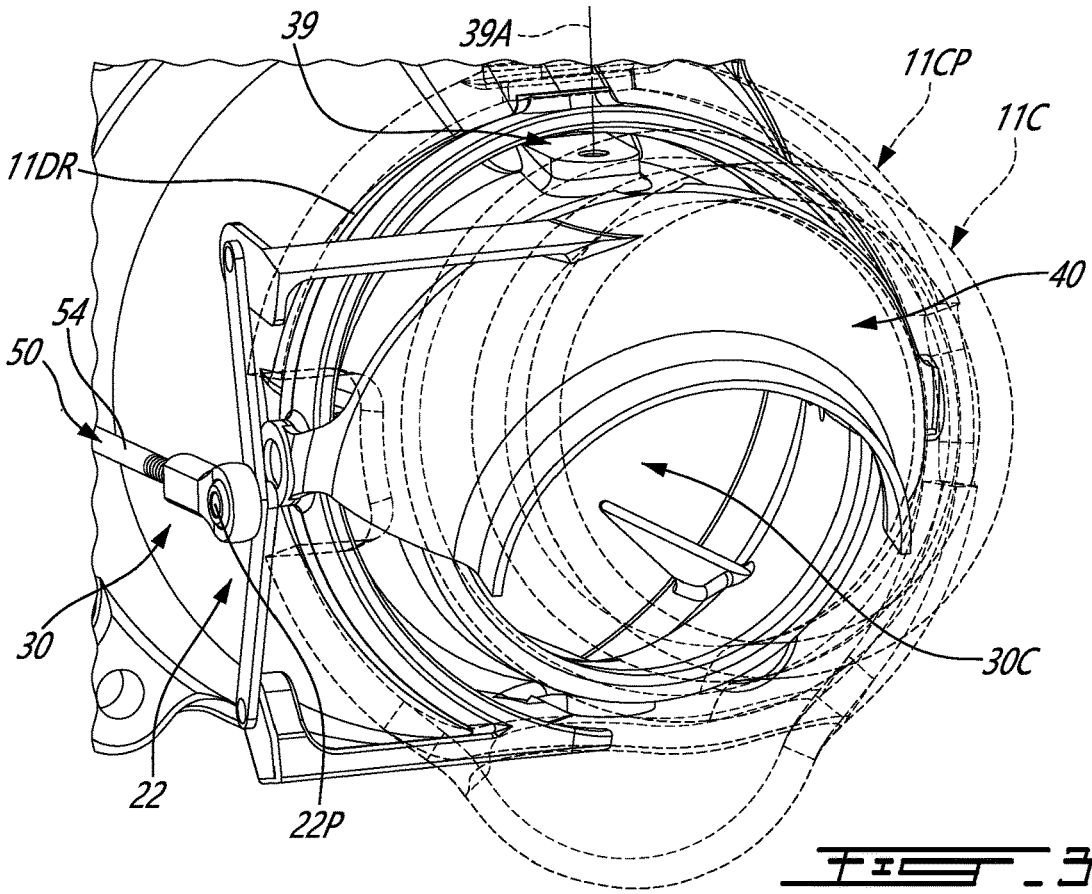
FIG. 3H is another perspective view of a what is shown in FIG. 3A.
Figure 3I:
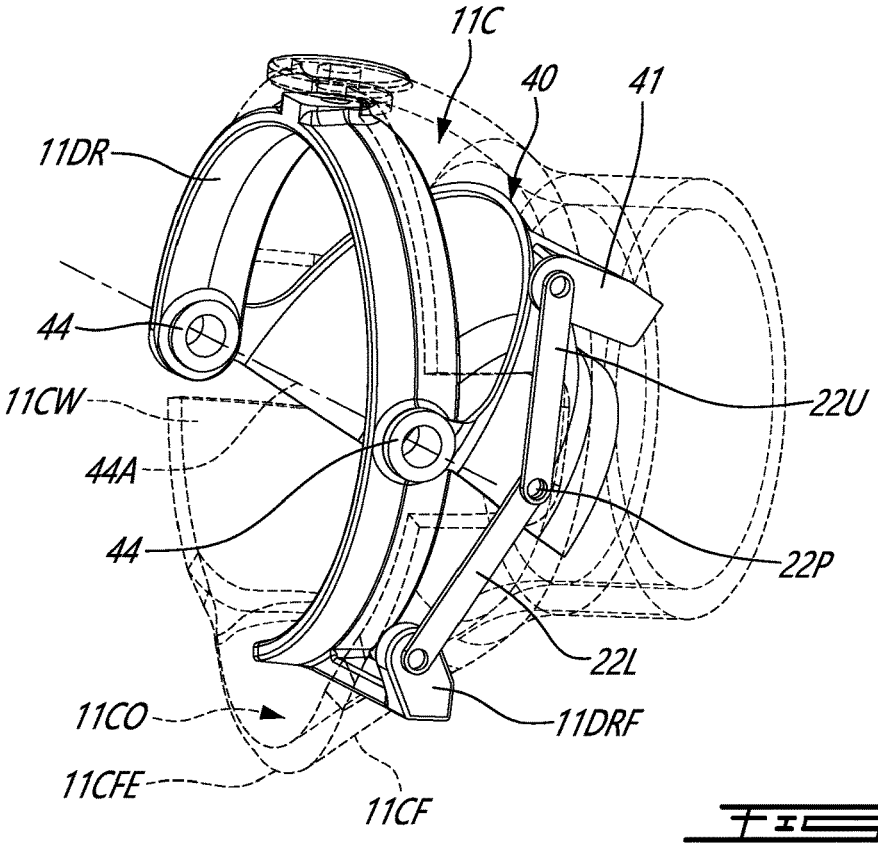
FIG. 3I is a perspective view of the steering nozzle and deflector gate of FIG. 3A.

This may be better appreciated with reference to FIGS. 3H and 3I. Referring to FIGS. 3H and 3I, the steering nozzle 11C is shown trimmed up and the deflector gate 40 is shown pivoted down into the deflector position to generate a reverse propulsive thrust. The steering nozzle 110 is also shown being pivoted laterally relative to the housing 30 about a steering axis 39A. The steering axis 39A is defined by a steering pivot 39 which is formed by any suitable fastener or mechanical object which pivotably connects the upper portion 11CP of the steering nozzle 110 and the pivot ring 11DR to the top of the housing 30 at the outlet 30C thereof. The pivot ring 11DR and the steering nozzle 110 are able to pivot in a left-right or lateral direction about the steering axis 39A. This lateral or steering pivoting movement of the steering nozzle 110 relative to the housing 30 may be achieved with an actuator that operates separately from the actuator 50. The steering nozzle 110 is thus capable of both trim and steering pivoting movement, even when the deflector gate 40 is in the deflector position, such that the steering nozzle 110 provides steering ability even when the PWC 10 is travelling in reverse or is braking. Thus, the steering actuation of the steering nozzle 110 used to steer the PWC 10 while travelling forward may also be used to steer the PWC while it travels in reverse.

Another configuration of the steering nozzle 111C and the deflector gate 140 is shown in FIGS. 4A to 4G. The disclosure herein related to the steering nozzle 110 and the deflector gate 40 of FIGS. 3A to 3I applies mutatis mutandis to the steering nozzle 111C and to the deflector gate 140 of FIGS. 4A to 4G. The reference numbers for the features of the steering nozzle 110 and of the deflector gate 40 which appear in FIGS. 3A to 3I are applicable to the features of the steering nozzle 111C and of the deflector gate 140 shown in FIGS. 4A to 4G, unless specified otherwise.

Figure 4A:
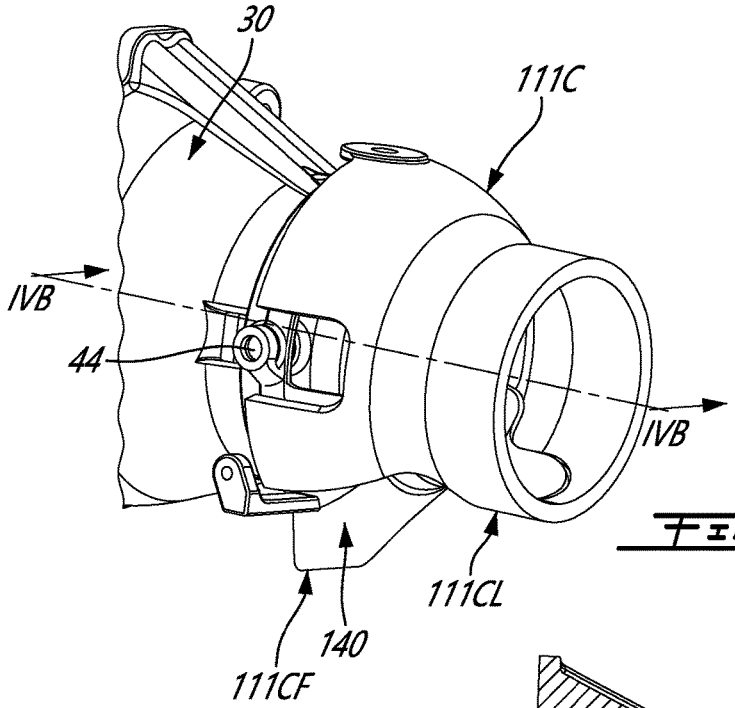
FIG. 4A is a perspective view of a housing, another steering nozzle, and another deflector gate of the jet propulsion assembly of FIG. 2A.
Figure 4B:
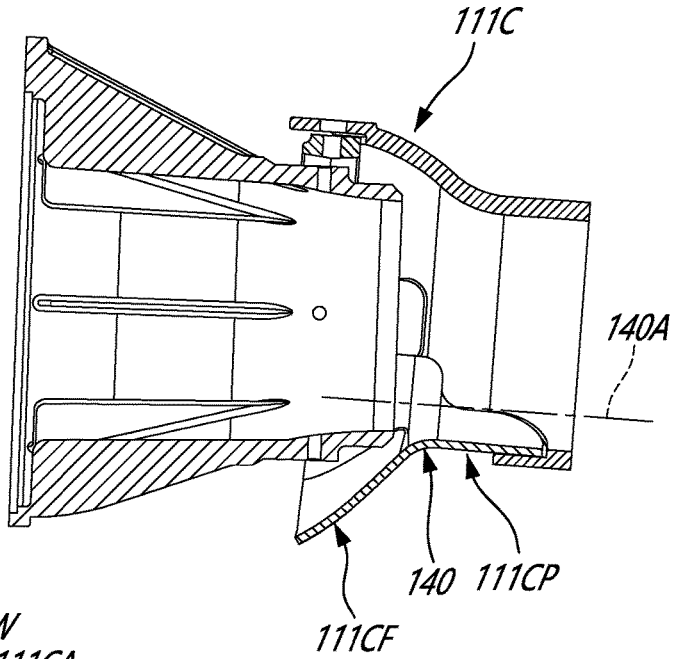
FIG. 4B is a cross-sectional view taken along the line IVB-IVB of FIG. 4A.
Figure 4C:
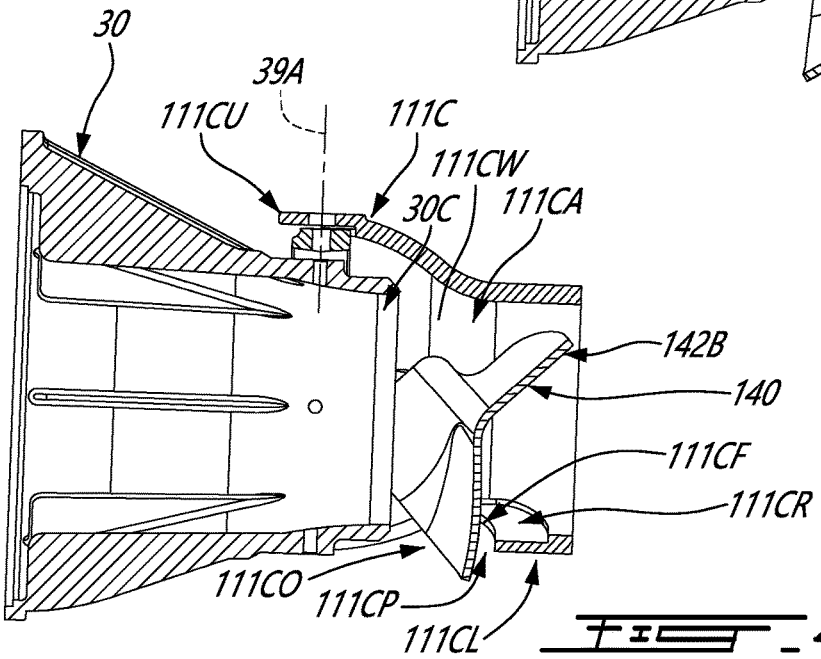
FIG. 4C is another cross-sectional view of FIG. 4A showing the deflector gate in a deflector position.

Referring to FIGS. 4A to 4C, the deflector gate 140 is pivotably mounted to the housing 30 at the pivot 44 which is positioned adjacent to the outlet 30C of the housing 30. The deflector gate 140 may be a partially-cylindrical, semi-cylindrical, partially-conical, partially-annular or partially-circumferential body positioned along the lower portion 111CL of the steering nozzle 111C in the default position. The opening 11100 of the steering nozzle 111C is defined at least in part by an aperture 111CP in the lower portion 111CL of the steering nozzle 111C. The aperture 111CP in the steering nozzle 111C is a through hole at the upstream end 111CU. The aperture 111CP in the steering nozzle 111C is a scalloped portion of the lower portion 111CL at the upstream end 111CU. The deflector gate 140 is displaced through the aperture 111CP when it pivots from the default position to the deflector position. Part of the deflector gate 140 extends through the aperture 111CP in the deflector position. The flow guide 111CF of the deflector gate 140 is displaceable through the aperture 111CP as the deflector gate 140 pivots relative to the steering nozzle 111C between the default position and the deflector position. The flow guide 111CF is in the form of a spout or a scoop that extends through the aperture 111CP in the steering nozzle 111C to direct water in the upstream direction when the deflector gate 140 is in the deflector position. The flow guide 111CF is a curved body forming a bottom portion of the deflector gate 140. In the default position of the deflector gate 140, an example of which is shown in FIG. 4B, the flow guide 111CF is substantially or entirely outside of the steering nozzle 111C, and is radially outward of the aperture 111CP. In the deflector position of the deflector gate 140, an example of which is shown in FIG. 4C, the flow guide 111CF is mostly or entirely in the nozzle interior 111CA, and partially extends through the aperture 111CP to guide the flow out of the steering nozzle 111C to generate the reverse propulsive thrust. The deflector gate 140 may be made from an easily-formable material, such as sheet metal, to achieve the desired shape for the deflector gate 140 and its flow guide 111CF. In some embodiments, the deflector gate 140 may be made from plastic using a molding process, for example.

Referring to FIGS. 4B and 4C, the lower portion 111CL of the steering nozzle 111C has a recessed segment 111CR. The recessed segment 111CR is a portion of the nozzle inner wall 111CW which is recessed from a remainder of the nozzle inner wall 111CW. A radial thickness of the steering nozzle 111C along the recessed segment 111CR is less than a radial thickness of the remainder of the steering nozzle 111C. The recessed segment 111CR delimits the aperture 111CP in the lower portion 111CL. The recessed segment 111CR is the most upstream segment of the lower portion 111CL of the steering nozzle 111C. The recessed segment 111CR is curved. The recessed segment 111CR is shaped to receive therein part of the deflector gate 140 when it is in the default position, as shown in FIG. 4B, such that the deflector gate 140 is substantially flush with the nozzle inner wall 111CW and not interfering with the flow of water through the nozzle interior 111CA when in the default position. Thus, at least part of the deflector gate 140 is disposed in the recessed segment 111CR in the default position. At least part of the second end 142B of the deflector gate 140 is disposed in the recessed segment 111CR in the default position. When disposed in the recessed segment 111CR of the steering nozzle 111C, the deflector gate 140 in the default position blocks the aperture 111CP in the steering nozzle 111C, such that water is prevented or blocked from flowing through the aperture 111CP. Thus, when in the default position, part of the deflector gate 140 is substantially flush with the nozzle inner wall 111CW and thus minimally impacts the flow of water through the nozzle interior 111CA, and the deflector gate 140 is also blocking other potential exits of the water from the steering nozzle 111C, such that the deflector gate 140 in the default position ensures that the steering nozzle 111C generates forward propulsive thrust. By being flush with the nozzle inner wall 111CW in the default position, it may be possible to increase the length of the deflector gate 140 (i.e. measured parallel to the deflector gate center axis 140A), which may allow the deflector gate 140 to more fully block or obstruct the nozzle interior 111CA when the deflector gate 140 is in the deflector position.

Figure 4D:
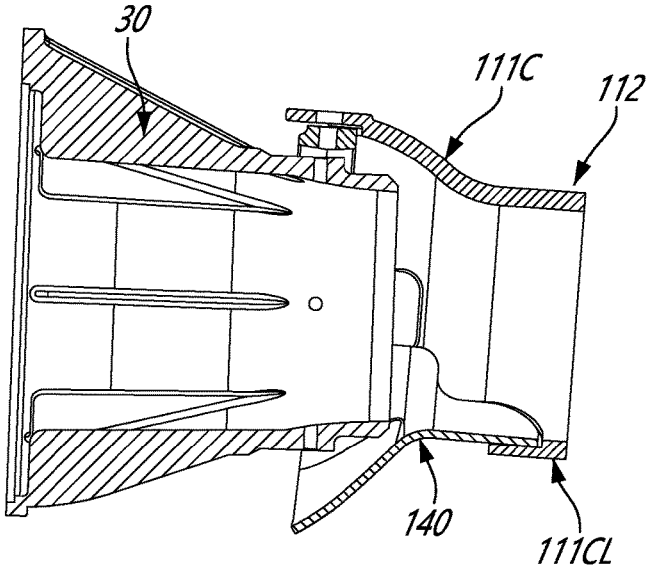
FIG. 4D is another cross-sectional view of FIG. 4A showing the deflector gate in a default position.
Figure 4E:
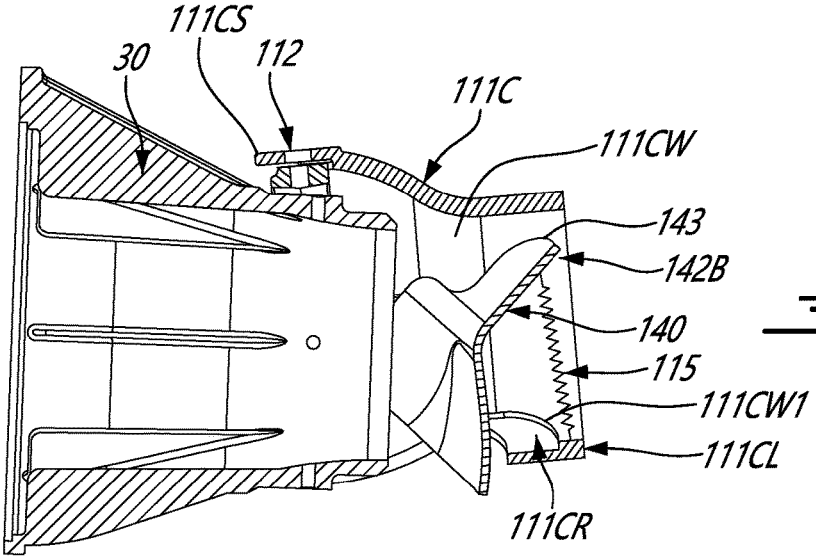
FIG. 4E is another cross-sectional view of FIG. 4A showing the deflector gate in the deflector position.
Figure 4F:
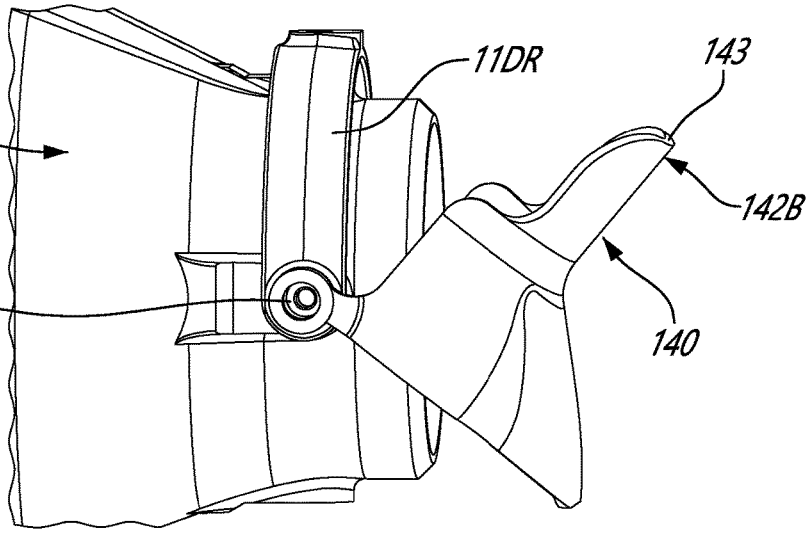
FIG. 4F is a perspective view of the housing and the deflector gate of FIG. 4A.

In an embodiment, an example of which is shown in FIGS. 4D to 4F, the actuator 50 and linkage 22 (not shown in these figures for clarity) are configured to displace the steering nozzle 111C and the deflector gate 140 together prior to the steering nozzle 111C reaching the upper or lower trim limit. The steering nozzle 111C and the deflector gate 140 displace together through the first range portion while the deflector gate 140 is in the default position. Referring to FIG. 4E, a biasing mechanism 115 such as a spring extends between the nozzle inner wall 111CW and the deflector gate 140, and functions to bias the deflector gate 140 toward and against the nozzle inner wall 111CW to the default position. The actuator 50 may be connected directly to the deflector gate 140 and operates through the first range portion and the second range portion of the range of actuation. When the actuator 50 is operating in the first range portion, the steering nozzle 111C is trimmed upwards and the deflector gate 140 pivots upwards with the steering nozzle 111C. The biasing mechanism 115 exerts a pulling force on the deflector gate 140 which maintains the deflector gate 140 flush against the nozzle inner wall 111CW through the first range portion. This pulling force exerted by the biasing mechanism 115 may be assisted in keeping the deflector gate 140 flush by the pressure of water flowing through the steering nozzle 111C and against the deflector gate 140. Thus, through the first range portion, the steering nozzle 111C and the deflector gate 140 displace upwardly together. In this embodiment, the deflector gate 140 is stationary relative to the steering nozzle 111C when the actuator 50 operates in the first range portion. When the steering nozzle 111C hits the trim limit, such as by a mechanical stop 111CS of the steering nozzle 111C abutting the housing 30, the actuator 50 operates through the second range portion such that continued application of force by the actuator 50 will cause the deflector gate 140 to displace relative to the steering nozzle 111C to the deflector position by stretching or otherwise deforming the biasing mechanism 115, thereby creating the reverse propulsive thrust. The actuator 50 in the second range portion overcomes the contraction force exerted by the biasing mechanism 115 when the deflector gate 140 is in the deflector position.

In an alternate embodiment, the actuator 50 and linkage 22 function to displace the deflector gate 140 relative to the steering nozzle 111C while maintaining the trim of the steering nozzle 111C. In this configuration of the first range portion of the range of actuation, the actuator 50 actuates the deflector gate 140 to the deflector position while not also adjusting the trim of the steering nozzle 111C. This may be achieved with multiple actuators, such that the trim actuator 50 is a first actuator for adjusting the trim of the steering nozzle 111C, and the jet propulsion system 11 includes a second actuator operable to pivot the deflector gate 140 relative to the steering nozzle 111C independently of any adjustment to the trim of the steering nozzle 111C. The deflector gate 140 may thus have a dedicated actuator for achieving movement of the deflector gate 140 independent of the trim of the steering nozzle 111C.

Referring to FIGS. 4D and 4E, the deflector gate 140 is pivotable relative to the steering nozzle 111C in an upward direction. When pivoting from the default position to the deflector position, the deflector gate 140 starts in the lower portion 111CL of the steering nozzle 111C (in the default position) and terminates in the deflector position with at least some of the deflector gate 140 in the upper portion 112 of the steering nozzle 111C. Thus, the default position of the deflector gate 140 is in the lower portion 111CL, and the deflector gate 140 is positioned in the upper portion 112 when deflecting water out of the steering nozzle 111C to generate the reverse propulsive thrust. Referring to FIG. 4E, in the deflector position, the deflector gate 140 is present in, or extends through, both the upper and lower portions 112,111CL of the steering nozzle 111C. Thus, to engage reverse thrust, the deflector gate 140 is actuated upwards, which at least partially blocks the downstream exit of the steering nozzle 111C while also exposing the aperture 111CP in the lower portion 111CL of the steering nozzle 111C.

Referring to FIGS. 4E and 4F, the second end 142B of the deflector gate 140 includes a curved edge 143. The curved edge 143 has a curvature that may correspond to the curvature of the wall 111CW1 of the nozzle inner wall 111CW that defines the recessed segment 111CR. This correspondence between the curvature of the curved edge 143 and the curvature of the wall 111CW1 allows the second end 142B of the deflector gate 140 to nest within the recessed segment 111CR in the default position. In an embodiment, and referring to FIG. 4E, the curved edge 143 abuts against the nozzle inner wall 111CW when the deflector gate 140 is in the deflector position, such that the deflector gate 140 substantially blocks the nozzle interior 111CA and deflects substantially all water to flow out of the aperture 111CP to generate the reverse propulsive thrust. In such an embodiment, the curvature of the curved edge 143 may also correspond to the curvature of the nozzle inner wall 111CW at the portion thereon where the curved edge 143 abuts the nozzle inner wall 111CW. It will be appreciated that the deflector gate 140 may be displaced to, and held at, an intermediate position between the default position and the deflector position, such that the deflector gate 140 is partially blocking the outlet of the steering nozzle 111C. In such an intermediate position, the deflector gate 140 may be effective in applying controlled braking to forward displacement of the PWC 10, by enabling some water to flow through the steering nozzle 111C to generate forward propulsive thrust and by diverting some water from the steering nozzle 111C to generate the reverse propulsive thrust.

The braking or reversing functionality of the PWC 10 may be selected by the operator of the PWC 10 for example via any suitable input on the steering mechanism 19. Alternatively, the braking functionality may come into effect automatically, such as when the operator of the PWC 10 releases the accelerator 34 on the steering mechanism 19. In an embodiment, the steering mechanism 19 includes a dedicated braking input, such as a lever or a throttle, which is configured to send a braking signal to the controller 32 of the PWC 10. In an embodiment, the steering mechanism 19 includes a dedicated reverse input, such as a switch, a button, a dedicated reverse throttle lever (i.e., different from a forward throttle lever) or another tactile input, which is configured to send a reverse signal to the controller 32 of the PWC 10. Thus, the PWC 10 may be operated to intentionally or automatically select one of a braking drive mode and a reverse drive mode (other drive moves of the PWC 10 include, for example, forward drive mode or neutral mode). When the brake or reverse drive modes are selected, the controller 32 of the PWC 10 may send a signal to the actuator 50 to operate through the first and second range portions of the range of actuation to cause the steering nozzle 11C,111C and/or the deflector gate 40,140 to trim towards the trim limit and cause displacement of the deflector gate 40,140 to the deflector position.

Figure 4G:
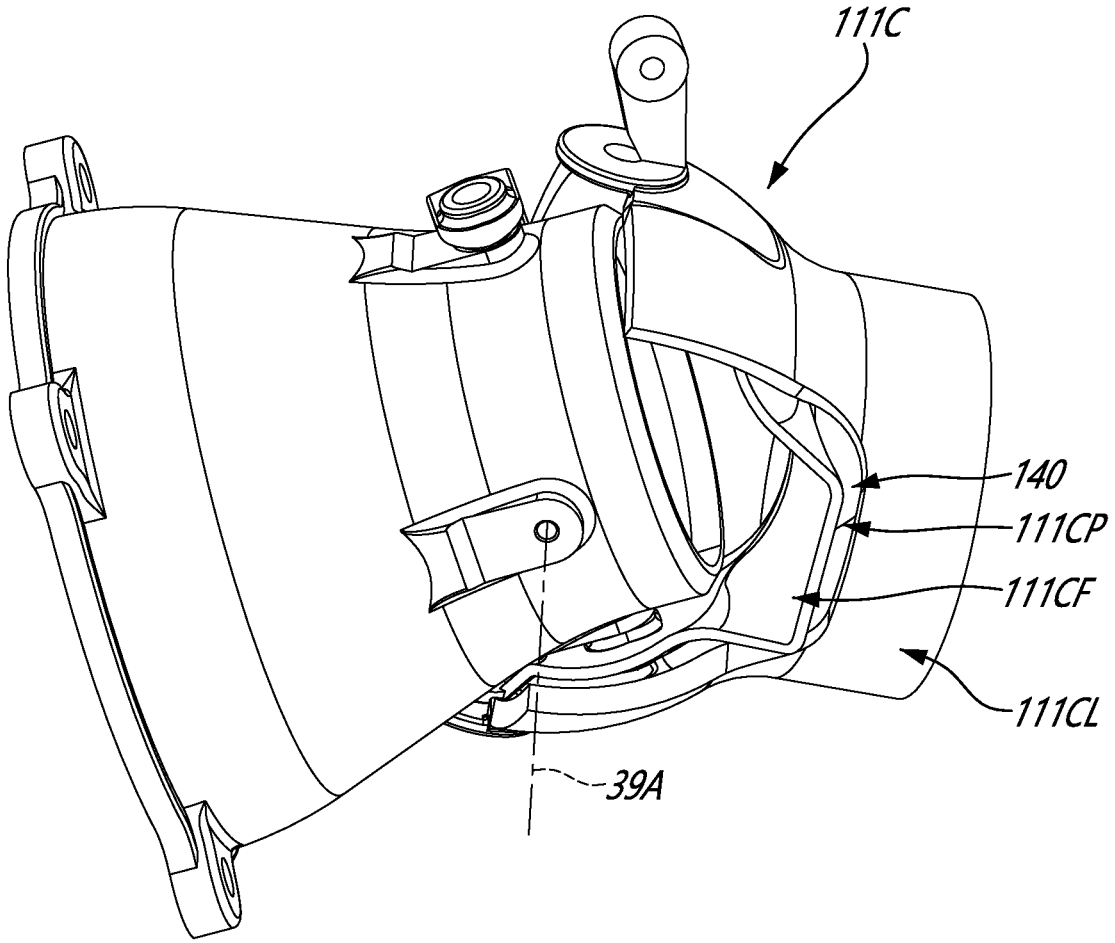
FIG. 4G is another perspective view of what is shown in FIG. 4A.

Referring to FIG. 4G, the steering nozzle 111C is shown having an upward trim and in a laterally-pivoted position resulting from its rotation about the steering axis 39A. The deflector gate 140 is shown in the deflector position with the flow guide 111CF extending through the aperture 111CP in the lower portion 111CL of the steering nozzle 111C. The steering nozzle 111C and the deflector gate 140 in the position shown in FIG. 4G allow for steering the PWC 10 even while the steering nozzle 111C generates the reverse propulsive thrust.

Figure 5:
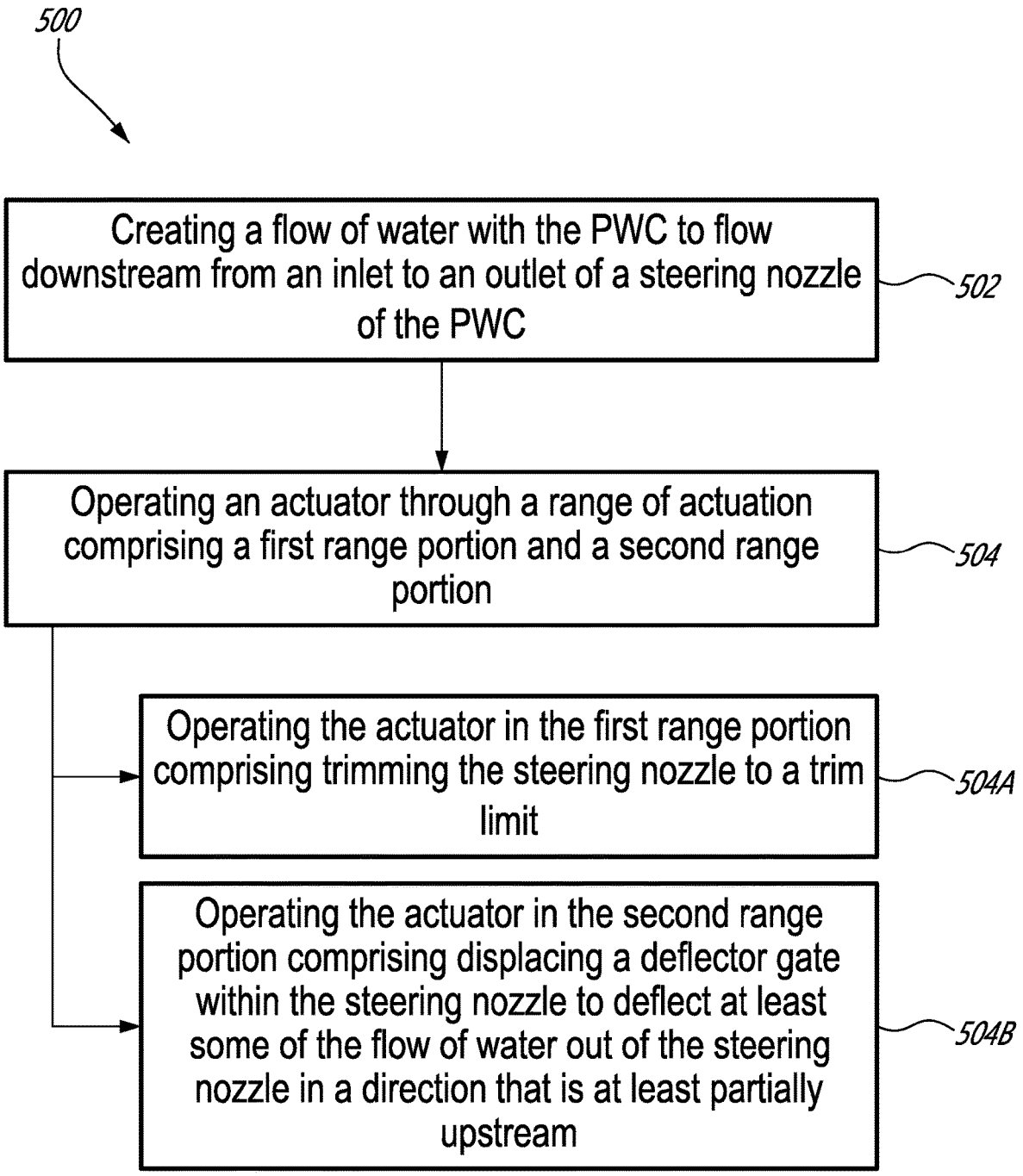
FIG. 5 is an illustration of a method disclosed herein.

Referring to FIG. 5, there is disclosed a method 500 of braking/slowing down or reversing the PWC 10. At 502, the method 500 includes creating a flow of water with the PWC 10, such as by rotating the impeller 15 to drive water through the steering nozzle 11C,111C, such that the water flows downstream from an inlet to an outlet of the steering nozzle 11C,111C. At 504, the method includes operating the actuator 50 through the range of actuation including the first range portion and the second range portion. At 504A, operating the actuator 50 in the first range portion includes trimming the steering nozzle 11C,111C to the trim limit. At 504B, operating the actuator in the second range portion includes displacing the deflector gate 40,140 within the steering nozzle 11C,111C to deflect at least some of the flow of water out of the steering nozzle 11C,111C in a direction D1 that is at least partially upstream. The method 500 at 504B may be performed after the method 500 at 504A.

Although the deflector gate 40,140 is described herein as being pivotable relative to the steering nozzle 11C,111C when the steering nozzle 11C,111C is being trimmed up and/or after it has reached an upper trim limit, it will be appreciated that the deflector gate 40,140 may be pivoted to the deflector position to generate reverse propulsive thrust when the steering nozzle 11C,111C is trimmed down and/or after it has reached the lower trim limit. In such an embodiment, the steering nozzle 11C,111C is pivotably displaceable in the vertical direction to orient the downstream end 11CD through a range of angular positions that includes the lower trim limit, or culminates in the lower trim limit, and all positions between zero trim and the lower trim limit. The actuator 50 operates through the first range portion of the range of actuation to pivot the steering nozzle 11C,111C (and possibly also the deflector gate 40,140) through the range of downward trim angular positions. In the second range portion, the actuator 50 is configured to pivot the deflector gate 40,140 relative to the steering nozzle 110,1110 to displace the deflector gate 40,140 to the deflector position upon the steering nozzle 110,1110 having displaced through the range of angular positions leading to the lower trim limit.

The embodiments described in this document provide non-limiting examples of possible implementations of the present technology. Upon review of the present disclosure, a person of ordinary skill in the art will recognize that changes may be made to the embodiments described herein without departing from the scope of the present technology. For example, it will be appreciated that the steering nozzle 110,1110 and the deflector gate 40,140 may have different shapes, and may have different positions relative to other features of the jet propulsion system 11, than are disclosed herein. It will also be appreciated that the features of the steering nozzle 110 and the deflector gate 40 of FIGS. 3A to 3I may be combined with, substituted for, or interchanged with, the features of the steering nozzle 111C and of the deflector gate 140 of FIGS. 4A to 4G. Yet further modifications could be implemented by a person of ordinary skill in the art in view of the present disclosure, which modifications would be within the scope of the present technology.

The invention claimed is:

1. A jet propulsion system, comprising:

a housing extending between an inlet and an outlet, the housing having an inner wall delimiting a housing interior;

an impeller positioned within the housing interior to draw water into the housing interior via the inlet and to expel the water from the outlet in a downstream direction;

a nozzle positioned at least partially downstream of the outlet and defining a nozzle interior to receive the water expelled from the outlet; and a deflector gate positioned at least partially within the nozzle interior, the deflector gate having a first end, a second end and a pivot provided at the first end, the deflector gate pivotable relative to the nozzle about a pivot axis defined by the pivot between a default position and a deflector position, the deflector gate in the default position having the second end downstream of the first end and in the deflector position deflecting at least some of the water out of an opening of the nozzle in an upstream direction.

2. The jet propulsion system of claim 1, wherein the deflector gate is pivotably mounted to one of the nozzle and the housing at the pivot, and the pivot is positioned adjacent to at least one of an upstream end of the nozzle and the outlet of the housing.

3. The jet propulsion system of claim 1, comprising an actuator connected to the deflector gate and configured to displace the deflector gate to the deflector position.

4. The jet propulsion system of claim 3, wherein the actuator is operable through a range of actuation, the range of actuation comprising:

a first range portion in which the actuator adjusts a nozzle trim of the nozzle to a trim limit, and a second range portion in which the actuator pivots the deflector gate relative to the nozzle, the nozzle trim having reached the trim limit when the actuator operates in the second range portion.

5. The jet propulsion system of claim 4, wherein the actuator is configured to displace the deflector gate to the deflector position only upon the nozzle having reached the trim limit.

6. The jet propulsion system of claim 1, wherein the opening of the nozzle is a first opening, the nozzle further defining a second opening at a downstream end to eject the water in the downstream direction.

7. The jet propulsion system of claim 1, wherein the nozzle includes an upper portion positioned above a lower portion, the deflector gate pivotable relative to the nozzle in a downward direction starting in the upper portion and terminating at the deflector position in the lower portion.

8. The jet propulsion system of claim 1, wherein the nozzle includes an upper portion positioned above a lower portion, the deflector gate pivotable relative to the nozzle in an upward direction starting in the lower portion and terminating at the deflector position in the upper portion.

9. The jet propulsion system of claim 1, wherein the nozzle includes an upper portion positioned above a lower portion, the opening of the nozzle defined at least in part by an aperture in the lower portion, the deflector gate being displaceable through the aperture between the default position and the deflector position.

10. The jet propulsion system of claim 9, wherein the deflector gate includes a flow guide displaceable through the aperture as the deflector gate pivots relative to the nozzle between the default position and the deflector position.

11. The jet propulsion system of claim 1, wherein the deflector gate has a semi-cylindrical shape.

12. A jet propulsion system, comprising:

a housing extending between an inlet and an outlet, the housing having an inner wall delimiting a housing interior;

an impeller positioned within the housing interior to draw water into the housing interior via the inlet and to expel the water from the outlet in a downstream direction;

a nozzle positioned at least partially downstream of the outlet and defining a nozzle interior to receive the water expelled from the outlet, the nozzle pivotably displaceable relative to the housing in at least a vertical direction to adjust nozzle trim;

a deflector gate positioned at least partially within the nozzle interior and pivotable relative to the nozzle; and an actuator connected to the nozzle and to the deflector gate and operable through a range of actuation, the range of actuation comprising:

a first range portion in which the actuator adjusts the nozzle trim to a trim limit, and a second range portion in which the actuator pivots the deflector gate relative to the nozzle, the nozzle trim having reached the trim limit when the actuator operates in the second range portion.

13. The jet propulsion system of claim 12, wherein the deflector gate is pivotably mounted to one of the nozzle and the housing at a pivot, and the pivot is positioned adjacent to at least one of an upstream end of the nozzle and the outlet of the housing.

14. The jet propulsion system of claim 12, wherein the actuator is configured to displace the deflector gate to the deflector position only upon the nozzle having reached the trim limit.

15. The jet propulsion system of claim 14, wherein the trim limit is an upper trim limit corresponding to the nozzle abutting against an outer wall of the housing.

16. The jet propulsion system of claim 12, wherein the deflector gate is stationary relative to the nozzle when the actuator operates in the first range portion.

17. The jet propulsion system of claim 12, wherein the deflector gate pivots relative to the nozzle when the actuator operates in the first range portion.

18. The jet propulsion system of claim 12, wherein the deflector gate in the deflector position deflecting at least some of the water out of an opening of the nozzle in an upstream direction.

19. The jet propulsion system of claim 18, wherein the opening of the nozzle is a first opening to eject water in an upstream direction, the nozzle further defining a second opening at a downstream end to eject the water in the downstream direction.

20. A method of braking or reversing a personal watercraft (PWC), the method comprising:

creating a flow of water with the PWC to flow downstream from an inlet to an outlet of a steering nozzle of the PWC; and operating an actuator through a range of actuation comprising a first range portion and a second range portion, operating the actuator in the first range portion comprising trimming the steering nozzle to a trim limit, and operating the actuator in the second range portion comprising displacing a deflector gate within the steering nozzle to deflect at least some of the flow of water out of the steering nozzle in a direction that is at least partially upstream.

* * * * *